US012582155B2

(12) United States Patent
Nielsen et al.

(10) Patent No.: US 12,582,155 B2
(45) Date of Patent: Mar. 24, 2026

(54) POUCHED PRODUCT

(71) Applicant: Fertin Pharma A/S, Vejle (DK)

(72) Inventors: Kent Albin Nielsen, Vejle (DK); Kim Bogh Pedersen, Vejle (DK); Bine Hare Jakobsen, Vejle (DK)

(73) Assignee: Fertin Pharma A/S, Vejle (DK)

( * ) Notice: Subject to any disclaimer, the term of this patent is extended or adjusted under 35 U.S.C. 154(b) by 0 days.

(21) Appl. No.: 18/870,339

(22) PCT Filed: Feb. 2, 2024

(86) PCT No.: PCT/DK2024/050025

§ 371 (c)(1),
(2) Date: Nov. 27, 2024

(87) PCT Pub. No.: WO2024/160333

PCT Pub. Date: Aug. 8, 2024

(65) Prior Publication Data

US 2025/0169532 A1 May 29, 2025

(30) Foreign Application Priority Data

Feb. 3, 2023 (DK) ..... PA 202370065

(51) Int. Cl.

| | |
|---|---|
| ***A24B 15/38*** | (2006.01) |
| ***A24B 13/00*** | (2006.01) |
| ***A24B 15/16*** | (2020.01) |
| ***A24B 15/32*** | (2006.01) |

(52) U.S. Cl.

CPC ..... *A24B 15/385* (2013.01); *A24B 13/00* (2013.01); *A24B 15/16* (2013.01); *A24B 15/32* (2013.01)

(58) Field of Classification Search

None

See application file for complete search history.

(56) References Cited

U.S. PATENT DOCUMENTS

| | | | | |
|---|---|---|---|---|
| 2016/0073689 | A1 | 3/2016 | Sebastian et al. | |
| 2018/0140007 | A1* | 5/2018 | Aspgren | A24F 23/02 |
| 2019/0174812 | A1* | 6/2019 | Nielsen | A61K 9/2009 |
| 2020/0383372 | A1* | 12/2020 | Stahl | A24B 15/243 |

(Continued)

FOREIGN PATENT DOCUMENTS

| | | | |
|---|---|---|---|
| WO | WO2021244892 | A1 | 12/2021 |
| WO | WO2022219310 | A1 | 10/2022 |

(Continued)

OTHER PUBLICATIONS

Office Action for Danish Application No. PA 2023 70065, Dated Jun. 11, 2024, 1 page.

(Continued)

*Primary Examiner* — Dennis R Cordray

(74) *Attorney, Agent, or Firm* — Lee & Hayes, P.C.

(57) ABSTRACT

A nicotine pouched product is disclosed, the pouched product comprising a pouch composition and a saliva-permeable pouch enclosing said pouch composition, the pouch composition comprising nicotine and a pouch substrate, the pouch substrate comprising water-insoluble fiber, wherein said pouch composition comprises nicotine in an amount of at least 0.25% by weight of the pouch composition, and wherein the pouched product comprises said pouch composition in an amount of no more than 400 mg.

20 Claims, 8 Drawing Sheets

(56) References Cited

U.S. PATENT DOCUMENTS

| | | | |
|---|---|---|---|
| 2021/0169790 | A1 | 6/2021 | Johnson et al. |
| 2021/0177044 | A1 | 6/2021 | Gerardi et al. |
| 2021/0307375 | A1 | 10/2021 | Stahl et al. |
| 2022/0151292 | A1 | 5/2022 | Nielsen et al. |

FOREIGN PATENT DOCUMENTS

| | | | |
|---|---|---|---|
| WO | WO2022224196 | A1 | 10/2022 |
| WO | WO2023084498 | A1 | 5/2023 |

OTHER PUBLICATIONS

Search Report for Danish Application No. PA 2023 70065, Dated Aug. 21, 2023, 5 pages.
Search Report and Written Opinion for International Application No. PCT/DK2024/050025, Dated Apr. 12, 2024, 7 pages.
Office Action for Danish Application No. PA 2023 70065, Dated Sep. 25, 2024, 8 pages.
Response to Office Action for Danish Application No. PA 2023 70065, Dated Nov. 1, 2024, 87 pages.
Office Action (Intent to Grant) for Danish Application No. PA 2023 70065, Dated Nov. 6, 2024, 1 page.

* cited by examiner

POUCHED PRODUCT

CROSS-REFERENCE TO RELATED APPLICATIONS

This application is a U.S. National Phase Application of International Application No. PCT/DK2024/050025, filed Feb. 2, 2024, which claims the benefit of Danish Application No. PA 2023 70065, filed Feb. 3, 2023, which are both incorporated herein by reference in their entirety.

FIELD OF INVENTION

The invention relates to a nicotine pouched product according to the claims, in particular to non-tobacco nicotine pouched products.

BACKGROUND

In the latest years a wide range of nicotine products having a reduced tobacco content or without tobacco has been seen, also within the field of pouched products or pouches.

Yet for pouched products, it remains a desire to provide a faster nicotine release in order to give the user an improved experience by means of faster craving relief.

SUMMARY

The invention relates to a nicotine pouched product comprising a pouch composition and a saliva-permeable pouch enclosing said pouch composition,

- the pouch composition comprising nicotine and a pouch substrate, the pouch substrate comprising water-insoluble fiber,
- wherein said pouch composition comprises nicotine in an amount of at least 0.25% by weight of the pouch composition, and
- wherein the pouched product comprises said pouch composition in an amount of no more than 400 mg.

One advantage of the invention may be that an unexpectedly fast release of nicotine may be obtained from the pouched product. Thereby, the use of the pouched product may facilitate a surprisingly but highly desirable fast nicotine craving relief.

A further advantage of the invention may be that a discreet pouch product may be obtained, i.e. a pouched product which may be used without other people noticing such use. In order to obtain a discreet pouched product, the present inventors found that a product with a smaller amount of pouch composition was desirable. At the same time, having a relatively high nicotine content was important to still provide efficient nicotine craving relief. However, it was surprisingly found that the decrease of the pouch substrate content in fact led to a faster release of nicotine, whereby faster nicotine craving relief was facilitated. In other words, despite reducing the content of the nicotine releasing pouch substrate, a faster release was obtained.

In the present context the term "discreet" refers to a pouch which appears small, before and/or during use. In more detail, a small looking pouch may thus have a reduced size and to appear small before use and during inserting into the mouth but may alternatively or in combination be smaller to make the use of the pouch less obvious for others, in particular by being thinner during use.

In the present context, the term "pouch substrate" refers to components of the pouch composition excluding the nicotine component. The nicotine component may in some embodiments be e.g. nicotine free base or may include a carrier, a salt counter ion or other components provided together with the nicotine, e.g. in the form of an ion exchange resin. Thus, the pouch substrate includes, besides the water-insoluble fiber, other non-nicotine components, if present, such as sugar alcohol, water, pH regulating agent, flavor, glidant, humectant, etc.

In the present context, the term "pouch composition" refers to the content of the pouch, i.e. the composition enclosed in the saliva-permeable pouch. Sometimes, the pouch composition may be referred to simply as the "composition", and thus when referring to "composition", this refer to the "pouch composition", unless otherwise specified.

In an advantageous embodiment of the invention, the pouched product comprises said pouch composition in an amount of no more than 350 mg, such as no more than 300 mg, such as no more than 250 mg, such as no more than 200 mg, such as no more than 150 mg, such as no more than 100 mg, such as no more than 50 mg.

An advantage of the above embodiment may be that a discreet product with a fast release of nicotine may be obtained.

In an embodiment of the invention, the pouched product comprises said pouch composition in an amount of 40-400 mg, such as 75-350 mg, such as 100-300 mg, such as 125-250 mg, such as 150-200 mg.

In an embodiment of the invention, the pouched product comprises said pouch composition in an amount of 40-400 mg, such as 40-300 mg, such as 40-200 mg, such as 40-150 mg, such as 40-100 mg, such as 75-100 mg.

In an advantageous embodiment of the invention, the pouched product comprises said pouch composition in an amount of at least 40 mg, such as at least 75 mg, such as at least 100 mg, such as at least 125 mg, such as at least 150 mg.

In an embodiment of the invention, the water-insoluble fiber comprises a non-tobacco fiber.

In an advantageous embodiment of the invention, the water-insoluble fiber is a non-tobacco fiber.

In an advantageous embodiment of the invention, the pouch composition comprises non-tobacco water-insoluble fiber in an amount of at least 5% by weight of the pouch composition, such as at least 10% by weight of the pouch composition, such as at least 15% by weight of the pouch composition.

Thus, the pouch composition of the above embodiment may comprise substantial amounts of non-tobacco water-insoluble fiber and in such cases may be a non-tobacco pouch composition or a low tobacco pouch composition.

In an advantageous embodiment of the invention, the pouch composition comprises non-tobacco water-insoluble fiber in an amount of at least 30% by weight of the pouch composition, such as at least 40% by weight of the pouch composition, such as at least 50% by weight of the pouch composition, such as at least 60% by weight of the pouch composition.

In an embodiment of the invention, the pouch composition comprises non-tobacco water-insoluble fiber in an amount of at least 50% by weight of the pouch composition.

In an embodiment of the invention, the pouch composition comprises non-tobacco water-insoluble fiber in an amount of at least 60% by weight of the pouch composition.

In an embodiment of the invention, the pouch composition comprises non-tobacco water-insoluble fiber in an amount of 5-80% by weight of the pouch composition, such as 5-70% by weight of the pouch compositions, such as 5-60% by weight of the pouch composition, such as at least 10-50% by weight of the pouch composition, such as at least 15-40% by weight of the pouch composition.

In an embodiment of the invention, the pouch composition comprises non-tobacco water-insoluble fiber in an amount of 30-90% by weight of the pouch composition, such as 40-90% by weight of the pouch compositions, such as 50-80% by weight of the pouch composition, such as at least 60-70% by weight of the pouch composition.

In an advantageous embodiment of the invention, the water-insoluble fibers are free of tobacco fibers.

Thus, in the above embodiment the water-insoluble fibers do not comprise any tobacco fibers or any fibers derived from tobacco, i.e. the water-insoluble fiber is a non-tobacco fiber. Whereas nicotine may be derived from tobacco or from other sources, the water-insoluble fibers do not comprise any tobacco fibers in the above embodiment.

In an advantageous embodiment of the invention, the pouch composition is free of tobacco fibers.

Thus, in the above embodiment the pouch composition does not comprise any tobacco fibers or any fibers derived from tobacco. Of course, whereas the nicotine may be derived from tobacco or from other sources, the pouch composition does not comprise any tobacco fibers in the above embodiment.

In an advantageous embodiment of the invention, the pouch composition is a non-tobacco pouch composition.

In an advantageous embodiment of the invention, the pouch composition is a powdered composition.

In an advantageous embodiment of the invention, the pouch has a maximum dimension of no more than 30 mm, such as no more than 25 mm, such as no more than 20 mm.

In an embodiment of the invention, the pouched product has at least one dimension of more than 24 mm, such as more than 30 mm.

In an embodiment of the invention, the saliva impermeable pouch has a substantially rectangular shape with a width and a length defining said rectangular shape, where the width is from 5 to 30 mm, such as from 10 to 25 mm, such as from 15 to 20 mm, and where the length is from 15 to 40 mm, such as from 20 to 30 mm, where shape including the width and the length is defined based on the saliva impermeable pouch in an empty state.

In an advantageous embodiment of the invention, the pouch composition comprises at least one sugar alcohol.

An advantage of the above embodiment may be that a desirable sweetness is provided, e.g. for support of the flavor profile, and while retaining an attractive texture.

It is noted that the at least one sugar alcohol, if present, is part of the pouch substrate.

In an advantageous embodiment of the invention, the pouch composition comprises said at least one sugar alcohol in an amount of at least 1% by weight of the pouch composition, such as at least 2% by weight of the pouch composition, such as at least 5% by weight of the pouch composition, such as at least 10% by weight of the pouch composition, such as at least 15% by weight of the pouch composition.

In an advantageous embodiment of the invention, the pouch composition comprises said at least one sugar alcohol in an amount of 1 to 80% by weight of the composition, such as 2 to 70% by weight of the composition, such as 5 to 60% by weight of the composition, such as 10 to 50% by weight of the composition, such as 15 to 50% by weight of the composition, such as 15 to 40% by weight of the composition, such as 15 to 30% by weight of the composition.

In an embodiment of the invention, the pouch composition comprises said at least one sugar alcohol in an amount of 5 to 70% by weight of the composition, such as 10 to 70% by weight of the composition, such as 15 to 70% by weight of the composition, such as 20 to 70% by weight of the composition, such as 20 to 60% by weight of the composition, such as 20 to 50% by weight of the composition, such as 20 to 40% by weight of the composition.

In an advantageous embodiment of the invention, said at least one sugar alcohol comprises one or more from the group consisting of xylitol, maltitol, mannitol, erythritol, isomalt, sorbitol, lactitol, glycerol, and any combinations thereof.

An advantage of the above embodiment may be that a desirable sweetness is provided, e.g. for support of the flavor profile, and while retaining an attractive texture.

Thus, in the above embodiment, the at least one sugar alcohol may include mixtures of different types of sugar alcohols, such as e.g. hydrogenated starch hydrolysates, which comprises a mixture of primarily maltitol, sorbitol and further sugar alcohols.

In an embodiment of the invention, said at least one sugar alcohol is selected from the group consisting of xylitol, maltitol, mannitol, erythritol, isomalt, sorbitol, lactitol, glycerol, and any combinations thereof.

In an advantageous embodiment of the invention, said at least one sugar alcohol comprises one or more from the group consisting of xylitol, maltitol, mannitol, erythritol, isomalt, sorbitol, lactitol, and any combinations thereof.

In an embodiment of the invention, said at least one sugar alcohol is selected from the group consisting of xylitol, maltitol, mannitol, erythritol, isomalt, sorbitol, lactitol, and any combinations thereof. In particular, by utilizing sugar alcohols with desirable characteristics with respect to e.g. melting point—e.g. being solid at ambient temperature of 25 degrees Celsius—a desirable texture is facilitated.

In an embodiment of the invention, the pouch composition comprises sugar alcohol selected from the group consisting of xylitol, maltitol, mannitol, erythritol, isomalt, sorbitol, lactitol, glycerol, and any combinations thereof in an amount of at least 1% by weight of the pouch composition, such as at least 2% by weight of the pouch composition, such as at least 5% by weight of the pouch composition, such as at least 10% by weight of the pouch composition, such as at least 15% by weight of the pouch composition.

In an embodiment of the invention, the pouch composition comprises sugar alcohol selected from the group consisting of xylitol, maltitol, mannitol, erythritol, isomalt, sorbitol, lactitol, and any combinations thereof in an amount of at least 1% by weight of the pouch composition, such as at least 2% by weight of the pouch composition, such as at least 5% by weight of the pouch composition, such as at least 10% by weight of the pouch composition, such as at least 15% by weight of the pouch composition.

In an advantageous embodiment of the invention, said at least one sugar alcohol comprises at least one non directly compressible (non-DC) grade sugar alcohol.

In an embodiment of the invention, the pouch composition comprises non-directly compressible (non-DC) grade sugar alcohol in an amount of at least 1% by weight of the pouch composition, such as at least 2% by weight of the pouch composition, such as at least 5% by weight of the pouch composition, such as at least 10% by weight of the pouch composition, such as at least 15% by weight of the pouch composition.

In an embodiment of the invention, the at least one sugar alcohol comprises non-directly compressible (non-DC)

grade sugar alcohol selected from the list consisting of xylitol, maltitol, mannitol, erythritol, isomalt, lactitol, and any combination thereof.

In an embodiment of the invention, the pouch the at least one further sugar alcohol comprises directly compressible (DC) grade sugar alcohol.

Thus, in some embodiments, the pouch composition comprises a combination of DC grade sugar alcohol(s) and non-DC grade sugar alcohol(s).

In an advantageous embodiment of the invention, the pouch composition comprises said water-insoluble fiber in an amount of at least 5% by weight of the pouch composition, such as at least 10% by weight of the pouch composition, such as at least 15% by weight of the pouch composition.

An advantage of the above embodiment may be that a desirable texture is facilitated e.g. by the ability of the water-insoluble fiber to hold substantial amounts of water.

In an embodiment of the invention, the pouch composition comprises said water-insoluble fiber in an amount of 5 to 80% by weight of the pouch composition, such as 5 to 70% by weight of the pouch composition, such as 5 to 60% by weight of the pouch composition, such as 10 to 45% by weight of the pouch composition, such as 15 to 40% by weight of the pouch composition.

In an embodiment of the invention, the pouch composition comprises said water-insoluble fiber in an amount of 5 to 50% by weight of the pouch composition, such as 5 to 45% by weight of the pouch composition, such as 5 to 40% by weight of the pouch composition.

In an embodiment of the invention, the pouch composition comprises said water-insoluble fiber in an amount of 10 to 70% by weight of the pouch composition, such as 10 to 60% by weight of the pouch composition, such as 10 to 50% by weight of the pouch composition, such as 15 to 50% by weight of the pouch composition.

In an advantageous embodiment of the invention, the water-insoluble fiber comprises one or more selected from the group consisting of wheat fibers, pea fibers, rice fiber, maize fibers, oat fibers, tomato fibers, barley fibers, rye fibers, sugar beet fibers, buckwheat fibers, potato fibers, apple fibers, cocoa fibers, bran fibers, bamboo fibers, powdered cellulose, and any combination thereof.

In an embodiment of the invention, the water-insoluble fiber is selected from the group consisting of wheat fibers, pea fibers, rice fiber, maize fibers, oat fibers, tomato fibers, barley fibers, rye fibers, sugar beet fibers, buckwheat fibers, potato fibers, apple fibers, cocoa fibers, bran fibers, bamboo fibers, powdered cellulose, and any combination thereof.

In an advantageous embodiment of the invention, the water-insoluble fiber comprises microcrystalline cellulose.

In an advantageous embodiment of the invention, the water-insoluble fiber is free of microcrystalline cellulose.

In an embodiment of the invention, the water-insoluble fiber has a water binding capacity of at least 200%, such as at least 300%, such as at least 400%.

In an embodiment of the invention, the water-insoluble fiber has a density of 50 to 500 gram per Liter, such as 100 to 400 gram per Liter, such as 200 to 300 gram per Liter.

In an embodiment of the invention, the pouch composition comprises water-insoluble fiber selected from the group consisting of wheat fibers, pea fibers, rice fiber, maize fibers, oat fibers, tomato fibers, barley fibers, rye fibers, sugar beet fibers, buckwheat fibers, potato fibers, apple fibers, cocoa fibers, bran fibers, bamboo fibers, powdered cellulose, and any combination thereof in an amount of at least 5% by weight of the pouch composition, such as at least 10% by weight of the pouch composition, such as at least 15% by weight of the pouch composition.

In an advantageous embodiment of the invention, the pouch composition comprises tobacco in an amount of no more than 5% by weight of the pouch composition, such as no more than 2% by weight of the pouch composition, such as no more than 1% by weight of the pouch composition, such as no more than 0.5% by weight of the pouch composition, such as no more than 0.1% by weight of the pouch composition.

In an embodiment of the invention, the pouch composition comprises tobacco in an amount of 0.001-5% by weight of the pouch composition, such as 0.01-5% by weight of the pouch composition, such as 0.05-2% by weight of the pouch composition, such as 0.1-1% by weight of the pouch composition, such as 0.2-0.5% by weight of the pouch composition.

In an advantageous embodiment of the invention, the pouch composition comprises water in an amount of no more than 30% by weight of the pouch composition, such as no more than 25% by weight of the pouch composition, such as no more than 20% by weight of the pouch composition, such as no more than 15% by weight of the pouch composition, such as no more than 10% by weight of the pouch composition, such as no more than 5% of the pouch composition, such as where the pouch composition is free of water.

It is noted that the water, if present, is considered part of the pouch substrate.

In one embodiment of the invention, the pouch composition comprises water in an amount of 0 to 20% by weight of the pouch composition, such as 0.1 to 15% by weight of the pouch composition, such as 0.5 to 10% by weight of the pouch composition, such as 1 to 5% of the pouch composition.

In an embodiment of the invention, the pouch composition is substantially free of water.

In an embodiment of the invention, the pouch composition is free of water.

In an embodiment of the invention, the pouch composition comprises water in an amount of at least 5% by weight of the pouch composition.

In an advantageous embodiment of the invention, the pouch composition comprises water in an amount of at least 10% by weight of the pouch composition, such as at least 15% by weight of the pouch composition, such as at least 20% by weight of the pouch composition.

An advantage of the above embodiment may be that a desirable and soft texture of the pouched product is facilitated. Also, by including substantial amounts of water, release of nicotine may be facilitated. If the water content of the pouch composition is low, the pouch composition may absorb saliva for an undesirably long period, whereas a sufficiently wet pouch composition may facilitate fast release of nicotine.

In an advantageous embodiment of the invention, the pouch composition comprises water in an amount of no more than 65% by weight of the composition, such as no more than 60% by weight of the composition, such as no more than 50% by weight of the composition, such as no more than 40% by weight of the composition.

In an advantageous embodiment of the invention, the pouch composition comprises water in an amount of 10-65% by weight of the composition, such as 15-60% by weight of the composition, such as 15-50% by weight of the composition, such as 20-50% by weight of the composition, such as 20-40% by weight of the composition.

In an embodiment of the invention, the pouch composition comprises water in an amount of 15-65% by weight of the composition, such as 20-65% by weight of the composition, such as 25-65% by weight of the composition.

In an embodiment of the invention, the pouch composition comprises water in an amount of 15-65% by weight of the composition, such as 15-60% by weight of the composition, such as 15-50% by weight of the composition, such as 15-40% by weight of the composition.

In an embodiment of the invention, the pouch composition comprises water in an amount of 15-60% by weight of the composition, such as 15-50% by weight of the composition, such as 15-40% by weight of the composition, such as 15-30% by weight of the composition.

In an embodiment of the invention, the pouch composition comprises water in an amount of 5-60% by weight of the composition, such as 5-50% by weight of the composition, such as 10-40% by weight of the composition, such as 10-30% by weight of the composition.

In an embodiment of the invention, the pouch composition comprises water in an amount of 15-40% by weight of the composition.

In an advantageous embodiment of the invention, the pouch composition has a weight ratio of water-insoluble fiber to sugar alcohol, said weight ratio being from 0.1 to 10, such as from 0.2 to 5, such as from 0.3 to 4, such as from 0.5 to 2.

Thus, in the above embodiment, the weight ratio, which may be referred to as a water-insoluble fiber to sugar alcohol weight ratio, is the ratio between the content by weight of water-insoluble fiber and the content by weight of sugar alcohol. As an example, the weight ratio may be calculated by dividing the content by weight (i.e. the percentage by weight) of water-insoluble fiber by the content by weight (i.e. the percentage by weight) of sugar alcohol.

It is noted that a weight ratio of e.g. 1 may also be expressed as 1:1. Similarly, a weight ratio of 0.5 may be expressed as 1:2, and a weight ratio of 2 may be expressed as 2:1.

In an advantageous embodiment of the invention, the pouch composition has a weight ratio of water-insoluble fiber to water, said weight ratio being from 0.2 to 5.0, such as from 0.5 to 2.0, such as from 0.6 to 1.6, such as from 0.7 to 1.4, such as from 0.8 to 1.2.

Thus, in the above embodiment, the weight ratio, which may be referred to as a water-insoluble fiber to water weight ratio, is the ratio between the content by weight of water-insoluble fiber and the content by weight of water.

In an advantageous embodiment of the invention, the pouch composition has a weight ratio of water-insoluble fiber to nicotine, said weight ratio being from 2 to 100, such as from 3 to 50, such as from 3 to 40, such as from 4 to 30, such as from 4 to 20.

Thus, in the above embodiment, the weight ratio, which may be referred to as a water-insoluble fiber to nicotine weight ratio, is the ratio between the content by weight of water-insoluble fiber and the content by weight of nicotine, calculated as the amount of nicotine base.

In an advantageous embodiment of the invention, the pouch composition comprises nicotine in an amount of at least 0.25% by weight of the pouch composition, such as at least 0.5% by weight of the pouch composition, such as at least 1.0% by weight of the pouch composition, such as at least 2.0% by weight of the pouch compositions, such as at least 4.0% by weight of the pouch compositions, such as at least 5.0% by weight of the pouch compositions, such as at least 6.0% by weight of the pouch compositions.

In an embodiment of the invention, the pouch composition comprises nicotine in an amount of 0.25% and 15.0% by weight of the pouch composition, such as 0.5% and 10.0% by weight of the pouch composition, such as 1.0% and 8.0% by weight of the pouch composition, such as 2.0% and 5.0% by weight of the pouch compositions.

In an embodiment of the invention, the pouch composition comprises nicotine in an amount of 3.0% and 20.0% by weight of the pouch composition, such as 4.0% and 20.0% by weight of the pouch composition, such as 5.0% and 15.0% by weight of the pouch composition, such as 6.0% and 10.0% by weight of the pouch compositions.

In an embodiment of the invention, the pouch composition comprises nicotine in an amount of no more than 20.0% by weight of the pouch composition, such as no more than 15.0% by weight of the pouch composition, such as no more than 10.0% by weight of the pouch composition, such as no more than 5% by weight of the pouch composition, such as no more than 2.0% by weight of the pouch composition, such as no more than 1.0% by weight of the pouch composition.

In an advantageous embodiment of the invention, the pouch composition comprises nicotine in an amount of at least 1 mg, such as at least 2 mg, such as at least 4 mg, such as at least 6 mg.

In an embodiment of the invention, the pouch composition comprises nicotine in an amount of 1 mg to 25 mg, such as 2 mg to 20 mg, such as 4 mg to 15 mg, such as 6 mg to 10 mg.

In an advantageous embodiment of the invention, the nicotine is selected from the group consisting of a nicotine salt, nicotine free base, a nicotine-ion exchange resin combination, a nicotine inclusion complex or nicotine in any non-covalent binding; nicotine bound to zeolites; nicotine bound to cellulose, such as microcrystalline cellulose, or starch microspheres, and mixtures thereof.

In an advantageous embodiment of the invention, the nicotine comprises non-salt nicotine.

In an advantageous embodiment of the invention, the nicotine comprises nicotine free base.

In an embodiment of the invention, the nicotine comprises nicotine free base embedded in an alginate matrix.

In an advantageous embodiment of the invention, the nicotine comprises nicotine mixed with ion exchange resin.

In an advantageous embodiment of the invention, the nicotine comprises free-base nicotine mixed with ion exchange resin in a weight ratio between the free-base nicotine and the ion exchange resin of 0.1 to 2.0, preferably from 0.5 to 2.0, and most preferred about 0.67 to 1.0.

In an advantageous embodiment of the invention, the nicotine comprises a nicotine salt.

In an embodiment of the invention, the nicotine salt is selected from nicotine ascorbate, nicotine aspartate, nicotine benzoate, nicotine monotartrate, nicotine bitartrate, nicotine chloride (e.g., nicotine hydrochloride and nicotine dihydrochloride), nicotine citrate, nicotine fumarate, nicotine gensitate, nicotine lactate, nicotine mucate, nicotine laurate, nicotine levulinate, nicotine malate nicotine perchlorate, nicotine pyruvate, nicotine salicylate, nicotine sorbate, nicotine succinate, nicotine zinc chloride, nicotine sulfate, nicotine tosylate and hydrates thereof (e.g., nicotine zinc chloride monohydrate).

In an advantageous embodiment of the invention, the nicotine salt comprises nicotine bitartrate.

The term NBT may be used as an abbreviation to denote nicotine bitartrate.

According to an embodiment of the invention, the nicotine salt is nicotine bitartrate.

In an advantageous embodiment of the invention, the nicotine comprises nicotine bound to an ion exchange resin.

In an advantageous embodiment of the invention, the nicotine comprises nicotine polacrilex resin.

In an advantageous embodiment of the invention, the nicotine comprises synthetic nicotine.

In an advantageous embodiment of the invention, the nicotine pouch composition is adapted to release more than 50% of the nicotine content within a period of 30 minutes, such as more than 60% of the nicotine content within a period of 30 minutes, such as more than 70% of the nicotine content within a period of 30 minutes, such as more than 80% of the nicotine content within a period of 30 minutes, such as more than 85% of the nicotine content within a period of 30 minutes, such as more than 90% of the nicotine content within a period of 30 minutes.

In an advantageous embodiment of the invention, the nicotine pouch composition is adapted to release more than 80% of the nicotine content within a period of 30 minutes.

In an advantageous embodiment of the invention, the nicotine pouch composition is adapted to release more than 85% of the nicotine content within a period of 30 minutes.

In an advantageous embodiment of the invention, the nicotine pouch composition is adapted to release more than 90% of the nicotine content within a period of 30 minutes. In an embodiment of the invention, the nicotine pouch composition is adapted to release more than 80% of the nicotine content within a period of no more than 30 minutes, such as within a period of no more than 25 minutes, such as within a period of no more than 20 minutes, such as within a period of no more than 15 minutes, such as within a period of no more than 10 minutes, such as within a period of no more than 5 minutes.

In an embodiment of the invention, the nicotine pouch composition is adapted to release no more than 99.9% of the nicotine content within a period of 30 minutes, such as no more than 99.5% of the nicotine content within a period of 30 minutes, such as no more than 99% of the nicotine content within a period of 30 minutes, such as no more than 98% of the nicotine content within a period of 30 minutes, such as no more than 95% of the nicotine content within a period of 30 minutes.

In an embodiment of the invention, the nicotine pouch composition is adapted to 50 to 100% of the nicotine content within a period 30 minutes, such as 50-99.9% of the nicotine content within a period of 30 minutes, such as 60-99.5% of the nicotine content within a period of 30 minutes, such as 70-99% of the nicotine content within a period of 30 minutes, such as 80-98% of the nicotine content within a period of 30 minutes, such as 90-95% of the nicotine content within a period of 30 minutes.

According to an embodiment of the invention, the nicotine pouch composition release is measured in vitro.

According to an embodiment of the invention, the nicotine pouch composition release is measured in vitro by the following steps of:

providing a chewing buffer, wherein said chewing buffer comprises a volume of 10 L and a pH of 7.4, and wherein said chewing buffer is degassed and heated to 38 degrees Celsius with a dissolution media preparation station, transferring 900 mL of said chewing buffer to a vessel in a dissolution apparatus, wherein said dissolution apparatus is a USP Dissolution Apparatus 1, adjusting said chewing buffer to 37 degrees Celsius, weighing a nicotine pouch, transferring said pouch to a basket in said vessel in said dissolution apparatus, setting a rotational speed to 100 rpm, collecting said nicotine pouch after a specified time period, determining release by filtering and analyzing said chewing buffer using standard HPLC.

In an advantageous embodiment of the invention, the pouch composition comprises a pH regulating agent.

It is noted that the pH regulating agent, if present, is part of the pouch substrate.

An advantage of the above embodiment may be that a more efficient absorption of nicotine through the oral mucosa may be facilitated.

In an advantageous embodiment of the invention, the pouch composition comprises pH regulating agent in an amount of 0.01 to 15% by weight of the pouch composition, such as in an amount of 0.5 to 10% by weight of the pouch composition, such as in an amount of 1 to 10% by weight of the pouch composition, such as in an amount of 2 to 10% by weight of the pouch composition, such as in an amount of 3 to 8% by weight of the pouch composition.

In an embodiment of the invention, the pouch composition comprises pH regulating agent in an amount of at least 0.01% by weight of the pouch composition, such as at least 0.5% by weight of the pouch composition, such as at least 1% by weight of the pouch composition, such as at least 2% by weight of the pouch composition, such as at least 3% by weight of the pouch composition, such as at least 4% by weight of the pouch composition, such as at least 5% by weight of the pouch composition.

In an embodiment of the invention, the pouch composition comprises pH regulating agent in an amount of no more than 15% by weight of the pouch composition, such as no more than 10% by weight of the pouch composition, such as no more than 8% by weight of the pouch composition, such as no more than 5% by weight of the pouch compositions.

In an advantageous embodiment of the invention, the pH regulating agent is a basic pH regulating agent, such as a basic buffering agent.

In an advantageous embodiment of the invention, the pH regulating agent is a buffering agent, such as a basic buffering agent.

In an advantageous embodiment of the invention, the pH regulating agent is selected from the group consisting of sodium carbonate, sodium bicarbonate, potassium carbonate, and magnesium carbonate, potassium bicarbonate, trometamol, phosphate buffer, or any combination thereof.

In the present context the term trometamol refers to (tris(hydroxymethyl)aminomethane), also sometimes referred to as tris buffer.

In an advantageous embodiment of the invention, the pouch composition comprises flavor.

It is noted that the flavor, if present, is part of the pouch substrate.

In an embodiment of the invention, the pouch composition comprises flavor in an amount of 0.01-15% by weight of the pouch composition.

In an embodiment of the invention, the flavor comprises liquid flavor.

In an embodiment of the invention, the flavor comprises powdered flavor.

In an embodiment of the invention, the flavor comprises liquid flavor and powdered flavor.

In an advantageous embodiment of the invention, the pouched product has a Surface Area to Volume (SAV) ratio of at least 0.6, such as at least 0.65, such as at least 0.7, such as at least 0.8, such as at least 1, such as at least 2, such as at least 3.

An advantage of the above embodiment may be that a high SAV ratio facilitates a fast release, e.g. due to more efficient interaction with saliva in the oral cavity.

In a further embodiment of the invention, the SAV ratio of the pouched product is at least 0.75, such as at least 0.8, such as at least 0.85, such as at least 0.9.

The term Surface Area to Volume ratio (SAV ratio) as used herein is a dimensionless ratio defined as the total surface area (SA) of the pouched product measured in $mm^2$ multiplied by 1 mm and divided by the volume (V) of the same pouched product measured in $mm^3$.

Sometimes within the present application, the term "surface area (SA) of the pouched product" may be referred to simply as the "pouch surface area" or "pouch area".

In an embodiment of the invention, the SAV ratio of the pouched product is no more than 20, such as no more than 15, such as no more than 10, such as no more than 8, such as no more than 5, such as no more than 3, such as no more than 2, such as no more than 1.

In an embodiment of the invention, the pouched product has a Surface Area to Volume (SAV) ratio of 0.6 to 20, such as 0.6 to 15, such as 0.6 to 10, such as 0.6 to 8, such as 0.6 to 5, such as 0.6 to 3, such as 0.65 to 2, such as 0.7 to 1.

In an embodiment of the invention, the pouched product has a Surface Area to Volume (SAV) ratio of 0.8 to 20, such as 1 to 20, such as 2 to 15, such as 3 to 10.

In an advantageous embodiment of the invention, the pouched product has a shortest dimension and a longest dimension with a ratio between said shortest dimension and said longest dimension of no more than 1:10.

In the present context it should be understood that the shortest dimension of the pouched product is the shortest distance passing through the center of the pouched product. Typically, the shortest dimension may thus be the thickness through the center or referred to as the maximum thickness. Similarly, the longest dimension is understood as the longest distance passing through the center of the pouched product. Thus, the longest dimension is a diagonal length of a rectangular shaped pouched product.

In an embodiment of the invention, the pouched product has a rectangular shape with a maximum thickness and a maximum length, and wherein a ratio between the maximum thickness and the maximum length is no more than no more than 1:2, such as no more than 1:4, such as no more than 1:5, such as no more than 1:8, such as no more than 1:10.

In an advantageous embodiment of the invention, the pouch product has a thickness of no more than 5 mm, such as no more than 4 mm, such as no more than 3 mm, such as no more than 2 mm, such as no more than 1.5 mm.

In an embodiment of the invention, the pouch has a maximum inner pouch volume and wherein the pouched product comprises said pouch composition in an amount of no more than 60% of said maximum inner pouch volume, such as no more than 55% of said maximum inner pouch volume, such as no more than 50% of said maximum inner pouch volume, such as no more than 45% of said maximum inner pouch volume, such as in an amount of no more than 40% of said maximum inner pouch volume, such as in an amount of no more than 35% of said maximum inner pouch volume, such as in an amount of no more than 30% of said maximum inner pouch volume.

In an embodiment of the invention, the pouch has a maximum inner pouch volume and wherein the pouched product comprises said pouch composition in an amount of 5-60% of said maximum inner pouch volume, such as in an amount of 5-55% of said maximum inner pouch volume, such as in an amount of 5-50% of said maximum inner pouch volume, such as in an amount of 5-45% of said maximum inner pouch volume, such as in an amount of 10-40% of said maximum inner pouch volume, such as in an amount of 15-35% of said maximum inner pouch volume, such as in an amount of 20-30% of said maximum inner pouch volume.

In an advantageous embodiment, the maximum inner pouch volume is at least 0.25 mL, such as at least 0.35 mL, such as at least 0.5 mL, such as at least 1.0 mL, such as at least 2.0 mL, such as at least 3.0 mL.

In an embodiment, the maximum inner pouch volume is within a range of 0.25 mL to 5.0 mL, such as 0.35 to 4.5 mL, such as 0.5 to 4.0 mL, such as 1.0 to 3.0 mL.

In an embodiment, the maximum inner pouch volume is within a range of 1.0 mL to 5.0 mL, such as 2.0 to 4.5 mL, such as 3.0 to 4.0 mL.

In an embodiment, the maximum inner pouch volume is within a range of 0.5 mL to 3.0 mL, such as 1.0 to 2.0 mL.

In an advantageous embodiment of the invention, the pouch composition further comprises one or more humectant(s).

In an embodiment of the invention, the pouch composition comprises humectants in an amount of 0.5 to 10% by weight of the pouch composition, such as 0.5 to 5% by weight of the pouch composition, such as 1-3% by weight of the pouch composition.

In an embodiment of the invention, the humectant(s) are selected from the group consisting of alginate, propylene glycol, hydroxypropyl cellulose, modified starch, triacetin, polyethylene glycol (PEG), pectin, and xanthan gum.

In an embodiment of the invention, the humectant(s) are selected from the group consisting of alginate, propylene glycol, and hydroxypropyl cellulose.

In an embodiment of the invention, the pouch composition is free of humectants selected from the group consisting of alginate, propylene glycol, and hydroxypropyl cellulose.

In an embodiment of the invention, the pouch composition is substantially free of humectants selected from the group consisting of alginate, propylene glycol, and hydroxypropyl cellulose.

In an embodiment of the invention, the pouch composition is free of humectants selected from the group consisting of alginate, propylene glycol, hydroxypropyl cellulose, modified starch, triacetin, polyethylene glycol (PEG), pectin, and xanthan gum.

In an embodiment of the invention, the pouch composition is free of xanthan gum.

In an embodiment of the invention, the pouch composition is free of ethyl cellulose.

In an advantageous embodiment of the invention, the pouch composition further comprises one or more solubilizers, such as copovidone.

In an embodiment of the invention, the pouch composition further comprises copovidone.

In an embodiment of the invention, the pouch composition comprises glidant, such as silicon dioxide.

In an embodiment of the invention, the pouch composition is substantially free of humectants.

In an embodiment of the invention, the pouch composition is free of humectants.

The invention further relates to a nicotine pouched product according to the invention or any of its embodiments for use in alleviation of nicotine craving.

The invention further relates to a method for alleviating nicotine craving, the method comprising administrating the nicotine pouched product according to the invention or any of its embodiments to a subject in need thereof.

In an embodiment of the invention, the nicotine pouched product comprises an effective amount of nicotine.

FIGURES

The invention will now be described with reference to the figures, where

DETAILED DESCRIPTION

Figure 1:
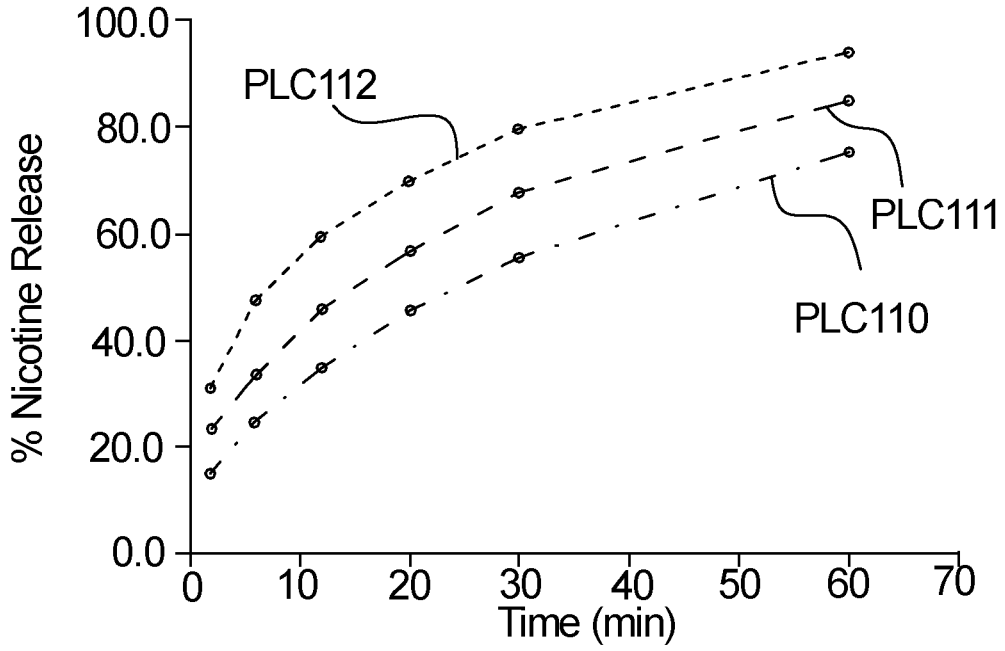
FIG. 1 illustrates fast nicotine release according to example 6.

As used herein the term "pouch composition" refers to the composition for use in an oral pouch, i.e. in pouches for oral use. Also, the terms "pouch composition" and "nicotine pouch composition" is used interchangeably.

As used herein the term "pouch" is intended to mean a container typically formed by a web of a fibrous material enclosing a cavity. The pouch is pouch designed for administration of an active ingredient in the oral cavity, and thus it is adapted for oral use, it is non-toxic and not water-soluble. The fibrous material may e.g. form a woven or non-woven web or fabric. The pouch may for example be sealed by bonding two corresponding pieces of web or fabric to each other along their edges to form a cavity for the nicotine and the non-water-soluble composition. In order to release the nicotine, the pouch is made water-permeable so as to allow saliva from the oral cavity to penetrate the pouch and enter the cavity, where the saliva can come into contact with the nicotine, whereby the nicotine is released from the oral pouch.

As used herein the term "humectant" is understood as a moistening agent used to keep pouches moist, i.e. a humectant is added to the pouch composition with the purpose of keeping the pouch moist. Hence, the term humectant does not refer to substances added for other purposes, hereunder also hygroscopic substances added for other purposes, such as sugar alcohols, water-insoluble fibers and glycerol associated with ion-exchange resin in nicotine-ion exchange resin combinations, such as nicotine polacrilex. Examples of humectants include alginate, propylene glycol, and hydroxypropyl cellulose.

As used here, a non-tobacco pouch composition refers to a non-tobacco based composition. In an embodiment of the invention, the non-tobacco pouch composition comprises at most 2% tobacco fibers, such as at most 0.01% tobacco fibers, or is free of tobacco fibers.

As used herein the term "nicotine" refers to nicotine used as a refined/isolated substance. Nicotine may be isolated from tobacco and added to pouch compositions. Particularly, nicotine does not refer to tobacco materials having a content of nicotine. Thus, when referring to nicotine amounts also to be understood as the nicotine dose, the amounts refers to the amount of pure nicotine. Nicotine also covers nicotine not obtained from tobacco, often referred to as synthetic nicotine.

As used herein, the term "nicotine-ion exchange resin combination" refer to a combination comprising nicotine complexed with ion exchange resin and/or nicotine mixed with ion exchange resin.

As used herein, the term "nicotine complexed with ion-exchange resin" refers to nicotine bound to an ion exchange resin. NPR (Nicotine Polacrilex Resin) is an example of nicotine bound to an ion exchange resin.

In the present context the term "free-base nicotine mixed with ion exchange resin" refers to a mixture comprising free-base nicotine and ion exchange resin. It is noted that even if some embodiments comprise a combination of nicotine complexed with ion exchange resin and nicotine in its free-base form mixed with ion exchange resin, the term "free-base nicotine mixed with ion exchange resin" requires the presence of nicotine in its free-base form. In some embodiments, the mixture is an aqueous mixture. Free-base nicotine and water is mixed with ion-exchange resin, whereby a mixture comprising both free-base nicotine and ion exchange resin is obtained. Free-base nicotine mixed with ion exchange resin is referred to as "premix" in the examples.

As used herein the term "powder composition" refers to composition in the form of powder, i.e. as a particulate material having a relatively small particle size, for example between 1 and 1200 micrometer. Particularly, by powder composition is not meant a powdered tobacco.

As used herein the term "free-base nicotine" refers to non-protonated form of nicotine, and therefore does not include nicotine salts or nicotine provided as a complex between nicotine and an ion exchange resin. Nevertheless, the free-base nicotine may be mixed with an amount of ion exchange resin or water-soluble compositions such as sugar alcohols or water-soluble fibers. While free-base nicotine includes both free-base nicotine extracted from tobacco as well as synthetically manufactured free-base nicotine, the free-base nicotine is not provided in the form of tobacco or powdered tobacco. Typically, free-base nicotine is provided as a liquid.

As used herein the term "water-insoluble" refers to relatively low water-solubility, for example a water-solubility of less than 0.1 gram of water-soluble composition or substance per 100 ml of water measured at 25 degrees Celsius, atmospheric pressure and pH of 7.0. When referring to "insoluble", water-insoluble is meant unless otherwise stated.

As used herein the term "effective release" refers to the total release of nicotine over the release period of the experiment or the use period.

As used herein, the term "dissolve" is the process where a solid substance enters a solvent (such as oral saliva or water within the pouch) to yield a solution.

The pouches of the invention provide a nicotine release into the oral cavity. A release profile of nicotine may be obtained which both comprises a fast release period and a sustained release period.

As used herein the term "fast release" or "fast release period" may refer to the initial 2 minutes of the nicotine release profile, whereas the term "sustained release period refers" to the subsequent period of the release profile until end of experiment or end of use.

As used herein the term "fast release rate" refers to the released nicotine per minute within the initial 2 minutes.

In an embodiment of the invention the pouch composition comprises high intensity sweetener.

Preferred high intensity sweeteners include, but are not limited to sucralose, aspartame, salts of acesulfame, such as acesulfame potassium, alitame, saccharin and its salts, cyclamic acid and its salts, glycyrrhizin, dihydrochalcones, thaumatin, monellin, stevioside and the like, alone or in combination.

In an embodiment of the invention, the pouch composition comprises acesulfame potassium.

In an embodiment of the invention, the pouch composition comprises sucralose.

In an embodiment of the invention, the pouch composition comprises dihydrochalcones.

In an embodiment of the invention, the pouch composition comprises bulk sweeteners including sugar and/or sugarless components.

In an embodiment of the invention, the pouch composition comprises bulk sweetener in the amount of 1.0 to about 80% by weight of the pouch composition, more typically constitute 5 to about 70% by weight of the pouch composition, and more commonly 10 to 60% by weight of the pouch composition or 10-50% by weight of the pouch composition. In some embodiments, inclusion of certain ingredients may limit the about amounts of bulk sweetener further.

The sweeteners may often support the flavor profile of the pouch composition.

Sugar sweeteners generally include, but are not limited to saccharide-containing components commonly known in the art of pouches, such as sucrose, dextrose, maltose, saccharose, lactose, sorbose, dextrin, trehalose, D-tagatose, dried invert sugar, fructose, levulose, galactose, corn syrup solids, glucose syrup, hydrogenated glucose syrup, and the like, alone or in combination.

The sugar sweetener can be used in combination with sugarless sweeteners. Generally, sugarless sweeteners include components with sweetening characteristics, but which are devoid of the commonly known sugars and comprise, but are not limited to, sugar alcohols comprising 4 or more carbons, such as sorbitol, mannitol, xylitol, hydrogenated starch hydrolyzates, maltitol, isomalt, erythritol, lactitol and the like, alone or in combination.

As used herein the term "flavor" is understood as having its ordinary meaning within the art. Flavor includes liquid and powdered flavors. Thus, flavors do of course not include sweeteners (such as sugar, sugar alcohols and high intensity sweeteners), or acids providing pure acidity/sourness, nor compounds providing pure saltiness (e.g. NaCl) or pure bitterness. Flavor enhancers include substances that only provide saltiness, bitterness or sourness. Flavor enhancers thus include e.g. sodium chloride, Citric acid, ammonium chloride etc.

The flavors can be natural or synthetic flavors.

In an embodiment of the invention the pouch composition comprises flavor. Flavor may typically be present in amounts between 0.01 and 15% by weight of the total composition of the pouch, such as between 0.01 and 5% by weight of the total composition.

Non-exhaustive examples of flavors suitable in embodiments of the present invention are coconut, coffee, chocolate, vanilla, grape fruit, orange, lime, menthol, liquorice, caramel aroma, honey aroma, peanut, walnut, cashew, hazelnut, almonds, pineapple, strawberry, raspberry, tropical fruits, cherries, cinnamon, peppermint, wintergreen, spearmint, *eucalyptus*, and mint, fruit essence such as from apple, pear, peach, strawberry, apricot, raspberry, cherry, pineapple, and plum essence. The essential oils include peppermint, spearmint, menthol, *eucalyptus*, clove oil, bay oil, anise, thyme, cedar leaf oil, nutmeg, and oils of the fruits mentioned above.

As used herein, the term "pH regulating agent" refers to agents, which active adjust and regulates the pH value of the solution to which they have been added or are to be added. Thus, pH regulating agents may be acids and bases, including acidic buffering agents and alkaline buffering agents. On the other hand, pH regulating agents does not including substances and compositions that can only affect the pH by dilution. Furthermore, pH regulating agents does not include e.g. flavoring, fillers, etc.

According to an embodiment of the invention, the pouch composition comprises one or more pH-regulating agent, such as a buffering agent.

In an embodiment of the invention, said pH-regulating agents are selected from the group consisting of Acetic acid, Adipic acid, Citric acid, Fumaric acid, Glucono-δ-lactone, Gluconic acid, Lactic acid, Malic acid, Maleic acid, Tartaric acid, Succinic acid, Propionic acid, Ascorbic acid, Phosphoric acid, Sodium orthophosphate, Potassium orthophosphate, Calcium orthophosphate, Sodium diphosphate, Potassium diphosphate, Calcium diphosphate, Pentasodium triphosphate, Pentapotassium triphosphate, Sodium polyphosphate, Potassium polyphosphate, Carbonic acid, Sodium carbonate, Sodium bicarbonate, Potassium carbonate, Calcium carbonate, Magnesium carbonate, Magnesium oxide, or any combination thereof.

According to a preferred embodiment of the invention, the pouch composition comprises one or more alkaline pH-regulating agent, such as an alkaline buffering agent.

In an embodiment of the invention, said alkaline pH-regulating agents are selected from the group consisting of Sodium diphosphate, Potassium diphosphate, Calcium diphosphate, Pentasodium triphosphate, Pentapotassium triphosphate, Sodium polyphosphate, Potassium polyphosphate, Sodium carbonate, Sodium bicarbonate, Potassium carbonate, Calcium carbonate, Magnesium carbonate, Magnesium oxide, or any combination thereof.

Typically, the pouches comprise openings, where the characteristic opening dimension is adapted to a characteristic dimension of the matrix composition so as to retain the matrix composition inside the pouch before use and/or to retain a part of the matrix composition, such as a water-insoluble composition, inside the pouch during use.

In order to obtain a pouch having suitable opening dimensions in view of the matrix composition to be used, the material for the pouch may be selected accordingly, e.g. comprising e.g. woven and/or non-woven fabric.

In other words, according to the various embodiments, the pouch forms a membrane allowing passage of saliva and prevents or inhibits passage of said matrix composition. The membrane of the pouch may be of any suitable material e.g. woven or non-woven fabric (e.g. cotton, fleece etc.), heat sealable non-woven cellulose or other polymeric materials such as a synthetic, semi-synthetic or natural polymeric material. An example of suitable pouch material is paper made of pulp and a small amount of wet strength agent. A material suitable for use must provide a semi-permeable membrane layer to prevent the powder or composition from leaving the bag or pouch during use. Suitable materials are also those that do not have a significant impact on the release of nicotine from the pouch.

The pouch composition is filled into pouches and is maintained in the pouch by a sealing. An ideal pouch is chemically and physically stable, it is pharmaceutically acceptable, it is insoluble in water, it is easy to fill with powder and seal, and it provides a semi-permeable membrane layer which prevent the powder from leaving the bag, but permit saliva and therein dissolved or sufficiently small suspended components from the pouch composition in the pouch, such as nicotine, to pass through said pouch.

The pouch may be placed in the oral cavity by the user. Saliva then enters into the pouch, and the nicotine and other components, which are soluble in saliva, start to dissolve and are transported with the saliva out of the pouch into the oral cavity, where the nicotine may be absorbed.

EXAMPLES

Example 1A—Preparation of Pouches Designed for Administration of Nicotine

The material of the pouches is heat sealable non-woven cellulose, such as long fiber paper. Pouches that are not in form of non-woven cellulose fabric may also be used according to the invention.

The powder is filled into pouches and is maintained in the pouch by a sealing.

Example 1B—Preparation of Pouches Designed for Administration of Nicotine

The material of the pouches is manufactured using rayon fibers, such as viscose rayon staple fibers. The pouch membrane is heat sealed along its edges except for an opening in one end into an inner cavity formed by the pouch membrane.

The powder is filled into pouches and is maintained in the pouch by a sealing.

Example 2: Preparation of Nicotine Premixes

A 60 liter planetary Bear Varimixer mixer was charged with water, and nicotine was weighed and added. The mixer was stirred at low speed for 1 minute at ambient temperature. Then ion exchange resin Amberlite® IRP64 was weighed and added to the mixer. The mixer was closed, stirred at high speed for 5 minutes, opened and scraped down, if necessary. Finally the mixer was stirred for further 5 minutes at high speed. The total process time was 20 minutes.

Thereby, mixtures of nicotine and cation exchange resin were produced from the constituents stated in the below tables.

Premix I:

TABLE 1

Ingredients used to manufacture nicotine premix I (5.7% nicotine).

| Constituent | Amount (kg) | Amount (%) |
|---|---|---|
| Nicotine | 1.0 | 5.7 |
| Water | 12.5 | 71.4 |
| Resin | 4.0 | 22.9 |
| Total | 17.5 | 100.0 |

% water in obtained nicotine-resin composition: 71.4

Premix II:

TABLE 2

Ingredients used to manufacture nicotine premix II (13.2% nicotine).

| Constituent | Amount (kg) | Amount (%) |
|---|---|---|
| Nicotine | 1.08 | 13.2 |
| Water | 2.80 | 34.1 |
| Resin | 4.32 | 52.7 |
| Total | 8.20 | 100.0 |

% water in obtained nicotine-resin composition: 34.1.

Premix III:

TABLE 3

Ingredients used to manufacture nicotine premix III (18.5% nicotine). % water in obtained nicotine-resin composition: 7.5.

| Constituent | Amount (kg) | Amount % |
|---|---|---|
| Nicotine | 1.08 | 18.5 |
| Water | 0.44 | 7.5 |
| Resin | 4.32 | 74.0 |
| Total | 5.84 | 100.0 |

Premix IV:

TABLE 4

Ingredients used to manufacture nicotine premix IV (10% nicotine). % water in obtained nicotine-resin composition: 50.0.

| Constituent | Amount (kg) | Amount (%) |
|---|---|---|
| Nicotine | 1.08 | 10.0 |
| Water | 5.40 | 50.0 |
| Resin | 4.32 | 40.0 |
| Total | 10.8 | 100.0 |

Premix V:

TABLE 5

Ingredients used to manufacture nicotine premix V (20% nicotine). % water in obtained nicotine-resin composition: 31.5.

| Constituent | Amount (kg) | Amount (%) |
|---|---|---|
| Nicotine | 1.78 | 20.0 |
| Water | 2.80 | 31.5 |
| Resin | 4.32 | 48.5 |
| Total | 8.90 | 100.0 |

Premix VI:

TABLE 6

Ingredients used to manufacture nicotine premix VI (30% nicotine). % water in obtained nicotine-resin composition: 27.5.

| Constituent | Amount (kg) | Amount (%) |
|---|---|---|
| Nicotine | 3.05 | 30.0 |
| Water | 2.80 | 27.5 |
| Resin | 4.32 | 42.5 |
| Total | 10.17 | 100.0 |

Premix VII:

TABLE 7

Ingredients used to manufacture nicotine premix VII (35% nicotine). % water in obtained nicotine-resin composition: 25.6.

| Constituent | Amount (kg) | Amount (%) |
|---|---|---|
| Nicotine | 3.83 | 35.0 |
| Water | 2.80 | 25.6 |
| Resin | 4.32 | 39.4 |
| Total | 10.95 | 100.0 |

Premix VIII:

TABLE 8

Ingredients used to manufacture nicotine premix VIII (42% nicotine). % water in obtained nicotine-resin composition: 22.8.

| Constituent | Amount (kg) | Amount (%) |
|---|---|---|
| Nicotine | 5.15 | 42.0 |
| Water | 2.80 | 22.8 |
| Resin | 4.32 | 35.2 |
| Total | 12.27 | 100.0 |

Example 3: Preparation of Pouch Compositions

Pouches are prepared comprising pouch compositions as outlined in table 9-21. The pouch compositions are made as follows.

Fibers and water are mixed using a planetary Bear Varimixer mixer for 5 minutes. Then, the following ingredients were added subsequently under continuous mixing: first the nicotine (mixed for 2 minutes), then the remaining ingredients except liquid flavor and glidant if any (mixed for 2 minutes), then liquid flavor if any (mixed for 1 minute), then glidant if any (mixed for 1 minute). The total mixing time is 9-11 minutes.

For pouch compositions comprising no or low amounts of water, the pouch compositions may alternatively be made as follows.

Fibers and other dry ingredients are mixed using a planetary Bear Varimixer mixer for 5 minutes. Then, the following ingredients were added subsequently under continuous mixing: first the nicotine (mixed for 2 minutes), then the remaining liquid ingredients if any, except liquid flavor and glidant if any (mixed for 2 minutes), then liquid flavor if any (mixed for 1 minute), then glidant if any (mixed for 1 minute). The total mixing time is 9-11 minutes.

Example 4: Preparation of Filled Pouches

The final pouch composition is filled into pouches (target fill weight 400 mg powder per pouch unless otherwise specifically indicated). The pouch material of example 1A or 1B may be used. The powder is filled into pouches and is maintained in the pouch by a sealing.

Example 5A: Pouches

The pouch compositions are prepared from the ingredients in table 9 using preparation method described in example 3.

The pouch compositions are filled into pouches as described in example 4 (pouch material of examples 1A was used, but 1B could also have been applied).

TABLE 9

Pouch compositions.

| Pouches | PLC 001 | PLC 002 | PLC 003 | PLC 004 | PLC 005 | PLC 006 | PLC 007 | PLC 008 | PLC 009 |
|---|---|---|---|---|---|---|---|---|---|
| Amount of nicotine | 9.6 mg | 9.6 mg | 9.6 mg | 9.6 mg | 9.6 mg | 9.6 mg | 9.6 mg | 9.6 mg | 5.6 mg |
| Water content [wt %] | 27 | 25 | 20 | 15 | 10 | 27 | 27 | 27 | 29 |
| Raw material | Content in weight percent | | | | | | | | |
| NPR (16%) | 17.1 | 17.1 | 17.1 | 17.1 | 17.1 | 17.1 | 17.1 | 17.1 | — |
| Premix II | — | — | — | — | — | — | — | — | 12.1 |
| Xylitol | 13.9 | 15.9 | 25.9 | 35.9 | 40.9 | 11.9 | 11.9 | 11.9 | 7.5 |
| Erythritol | — | — | — | — | — | — | — | — | 17.8 |
| Purified water | 27 | 25 | 20 | 15 | 10 | 27 | 27 | 27 | 25 |
| Wheat fiber | 25 | 25 | 20 | 15 | 15 | 25 | 25 | 25 | 30 |
| Sodium alginate | — | — | — | — | — | 2.0 | — | — | — |
| Glycerol | — | — | — | — | — | — | 2.0 | — | — |
| Hydroxypropyl cellulose | — | — | — | — | — | — | — | 2.0 | — |
| Sodium carbonate | 5.0 | 5.0 | 5.0 | 5.0 | 5.0 | 5.0 | 5.0 | 5.0 | 3.0 |
| Flavor | 8.9 | 8.9 | 8.9 | 8.9 | 8.9 | 8.9 | 8.9 | 8.9 | 2.5 |
| High intensity sweetener | 1.0 | 1.0 | 1.0 | 1.0 | 1.0 | 1.0 | 1.0 | 1.0 | — |
| Potassium sorbate | 0.1 | 0.1 | 0.1 | 0.1 | 0.1 | 0.1 | 0.1 | 0.1 | 0.1 |
| Silicon dioxide | 2.0 | 2.0 | 2.0 | 2.0 | 2.0 | 2.0 | 2.0 | 2.0 | 2.0 |
| Total | 100 | 100 | 100 | 100 | 100 | 100 | 100 | 100 | 100 |

Pouch content: 350 mg total.

The pouch compositions PLC 001-PLC 009 were also made as pouch PLC 001A-PLC 009A each with a pouch content of 200 mg total.

The pouch compositions PLC 001-PLC 009 were also made as pouch PLC 001B-PLC 009B each with a pouch content of 100 mg total.

NPR (16%) denotes nicotine polacrilex resin complex with a nicotine load of 16% by weight of the NPR complex.

Wheat fiber, trade name "Vitacel 600 WF plus". Other fibers may be used as well, such as water-insoluble plant fibers, such as oat fibers, pea fibers, rice fiber, maize fibers, oat fibers, tomato fibers, barley fibers, rye fibers, sugar beet fibers, buckwheat fibers, potato fibers, apple fibers, cocoa fibers, powdered cellulose, bran fibers, and bamboo fibers.

Sodium carbonate is used as an alkaline buffering agent. Other buffering agents as described herein may also be used in combination with sodium carbonate or an alternative.

Flavor example, a mixture of e.g. menthol and peppermint may be used. Of course, other flavors as described herein may be use as well, in combination with menthol and/or peppermint or replacing these. The flavor may be liquid or flavored or a combination, i.e. a liquid flavor and a powdered flavor is added.

Acesulfame potassium and/or sucralose may as an example be used as high intensity sweeteners. Other usable high intensity sweeteners described herein may be used in combination with or instead of acesulfame potassium and/or sucralose.

Potassium sorbate is used as a preservative. Other preservatives as described herein may also be used in combination with or instead of potassium sorbate.

Silicon dioxide is used as a glidant. Other possible glidants include e.g. magnesium stearate, starch and talc.

Example 5B: Pouches

The pouch compositions are prepared from the ingredients in table 10 using preparation method described in example 3.

The pouch compositions are filled into pouches as described in example 4 (pouch material of examples 1A was used, but 1B could also have been applied).

Pouch content: 400 mg total.

The pouch compositions PLC 020-PLC 024 were also made as pouch PLC 020A-PLC 024A each with a pouch content of 200 mg total.

The pouch compositions PLC 020-PLC 024 were also made as pouch PLC 020B-PLC 024B each with a pouch content of 100 mg total.

Wheat fiber, trade name "Vitacel 600 WF plus". Other fibers may be used as well, such as water-insoluble plant fibers, such as oat fibers, pea fibers, rice fiber, maize fibers, oat fibers, tomato fibers, barley fibers, rye fibers, sugar beet fibers, buckwheat fibers, potato fibers, apple fibers, cocoa fibers, powdered cellulose, bran fibers, and bamboo fibers.

Sodium carbonate is used as an alkaline buffering agent. Other buffering agents as described herein may also be used in combination with sodium carbonate or an alternative.

Flavor example, a mixture of e.g. menthol and peppermint may be used. Of course, other flavors as described herein may be use as well, in combination with menthol and/or peppermint or replacing these. The flavor may be liquid or flavored or a combination, i.e. a liquid flavor and a powdered flavor is added.

Acesulfame potassium and/or sucralose may as an example be used as high intensity sweeteners. Other usable high intensity sweeteners described herein may be used in combination with or instead of acesulfame potassium and/or sucralose.

Potassium sorbate is used as a preservative. Other preservatives as described herein may also be used in combination with or instead of potassium sorbate.

Silicon dioxide is used as a glidant. Other possible glidants include e.g. magnesium stearate, starch and talc.

Example 5C: Pouches

The pouch compositions are prepared from the ingredients in table 11 using preparation method described in example 3.

The pouch compositions are filled into pouches as described in example 4 (pouch material of examples 1A was used, but 1B could also have been applied).

TABLE 10

Pouch compositions.

| | Pouches | | | | |
|---|---|---|---|---|---|
| | PLC 020 | PLC 021 | PLC 022 | PLC 023 | PLC 024 |
| Amount of nicotine | 9.6 mg | 9.6 mg | 9.6 mg | 9.6 mg | 9.6 mg |
| Water content [wt %] | 28 | 26 | 21 | 16 | 11 |
| Raw material | Content in weight percent | | | | |
| Premix II | 18.2 | 18.2 | 18.2 | 18.2 | 18.2 |
| Xylitol | 17.8 | 19.8 | 29.8 | 39.8 | 44.8 |
| Purified water | 22 | 20 | 15 | 10 | 5 |
| Wheat fiber | 25 | 25 | 20 | 15 | 15 |
| Sodium carbonate | 5.0 | 5.0 | 5.0 | 5.0 | 5.0 |
| Flavor | 8.9 | 8.9 | 8.9 | 8.9 | 8.9 |
| High intensity sweetener | 1.0 | 1.0 | 1.0 | 1.0 | 1.0 |
| Potassium sorbate | 0.1 | 0.1 | 0.1 | 0.1 | 0.1 |
| Silicon dioxide | 2.0 | 2.0 | 2.0 | 2.0 | 2.0 |
| Total | 100 | 100 | 100 | 100 | 100 |

TABLE 11

| Pouch compositions. | | | | | | | | | |
|---|---|---|---|---|---|---|---|---|---|
| Pouches | PLC 030 | PLC 031 | PLC 032 | PLC 033 | PLC 034 | PLC 035 | PLC 036 | PLC 037 | PLC 038 |
| Amount of nicotine | 9.6 mg | 9.6 mg | 9.6 mg | 4.8 mg | 7.2 mg | 12.0 mg | 4.8 mg | 7.2 mg | 12.0 mg |
| Water content [wt %] | 27 | 30 | 28 | 27 | 27 | 27 | 28 | 28 | 28 |
| Raw material | Content in weight percent | | | | | | | | |
| NPR (16%) | 20.0 | — | — | 10.0 | 15.0 | 25.0 | — | — | — |
| Premix II | — | 24.2 | — | — | — | — | — | — | — |
| Premix VI | — | — | 10.7 | — | — | — | 5.3 | 8.0 | 13.3 |
| Xylitol | 11.0 | 11.8 | 22.3 | 21.0 | 16.0 | 6.0 | 26.7 | 24.0 | 19.7 |
| Purified water | 27 | 22 | 25 | 27 | 27 | 27 | 26 | 26 | 25 |
| Wheat fiber | 25 | 25 | 25 | 25 | 25 | 25 | 25 | 25 | 25 |
| Sodium carbonate | 5.0 | 5.0 | 5.0 | 5.0 | 5.0 | 5.0 | 5.0 | 5.0 | 5.0 |
| Flavor | 9.0 | 9.0 | 9.0 | 9.0 | 9.0 | 9.0 | 9.0 | 9.0 | 9.0 |
| High intensity sweetener | 1.0 | 1.0 | 1.0 | 1.0 | 1.0 | 1.0 | 1.0 | 1.0 | 1.0 |
| Silicon dioxide | 2.0 | 2.0 | 2.0 | 2.0 | 2.0 | 2.0 | 2.0 | 2.0 | 2.0 |
| Total | 100 | 100 | 100 | 100 | 100 | 100 | 100 | 100 | 100 |

Pouch content: 300 mg total.

The pouch compositions PLC 030-PLC 038 were also made as pouch PLC 030A-PLC 038A each with a pouch content of 200 mg total.

The pouch compositions PLC 030-PLC 038 were also made as pouch PLC 030B-PLC 038B each with a pouch content of 100 mg total.

Wheat fiber, trade name "Vitacel 600 WF plus". Other fibers may be used as well, such as water-insoluble plant fibers, such as oat fibers, pea fibers, rice fiber, maize fibers, oat fibers, tomato fibers, barley fibers, rye fibers, sugar beet fibers, buckwheat fibers, potato fibers, apple fibers, cocoa fibers, powdered cellulose, bran fibers, and bamboo fibers.

Sodium carbonate is used as an alkaline buffering agent. Other buffering agents as described herein may also be used in combination with sodium carbonate or an alternative.

Flavor example, a mixture of e.g. menthol and peppermint may be used. Of course, other flavors as described herein may be use as well, in combination with menthol and/or peppermint or replacing these. The flavor may be liquid or flavored or a combination, i.e. a liquid flavor and a powdered flavor is added.

Acesulfame potassium and/or sucralose may as an example be used as high intensity sweeteners. Other usable high intensity sweeteners described herein may be used in combination with or instead of acesulfame potassium and/or sucralose.

Silicon dioxide is used as a glidant. Other possible glidants include e.g. magnesium stearate, starch and talc.

Example 5D: Pouches

The pouch compositions are prepared from the ingredients in table 12 using preparation method described in example 3.

The pouch compositions are filled into pouches as described in example 4 (pouch material of examples 1A was used, but 1B could also have been applied).

TABLE 12

| Pouch compositions. | | | | | | | |
|---|---|---|---|---|---|---|---|
| Pouches | PLC 040 | PLC 041 | PLC 042 | PLC 043 | PLC 044 | PLC 045 | PLC 046 |
| Amount of nicotine | 9.6 mg | 9.6 mg | 9.6 mg | 9.6 mg | 4.8 mg | 7.2 mg | 12.0 mg |
| Water content [wt %] | 27 | 27 | 29 | 28 | 29 | 30 | 31 |
| Raw material | Content in weight percent | | | | | | |
| NPR (16%) | — | 12.3 | — | — | — | — | — |
| NBT | 9.8 | 3.8 | 3.8 | 3.8 | — | — | — |
| Premix II | — | — | 14.3 | — | 12.1 | 18.2 | 30.3 |
| Premix VI | — | — | — | 6.5 | — | — | — |
| Xylitol | 21.2 | 14.9 | 15.9 | 21.7 | 20.9 | 16.8 | 6.7 |
| Purified water | 27 | 27 | 24 | 26 | 25 | 23 | 21 |
| Wheat fiber | 25 | 25 | 25 | 25 | 25 | 25 | 25 |
| Sodium carbonate | 5.0 | 5.0 | 5.0 | 5.0 | 5.0 | 5.0 | 5.0 |

TABLE 12-continued

| Pouch compositions. | | | | | | | |
|---|---|---|---|---|---|---|---|
| Pouches | PLC 040 | PLC 041 | PLC 042 | PLC 043 | PLC 044 | PLC 045 | PLC 046 |
| Flavor | 8.9 | 8.9 | 8.9 | 8.9 | 8.9 | 8.9 | 8.9 |
| High intensity sweetener | 1.0 | 1.0 | 1.0 | 1.0 | 1.0 | 1.0 | 1.0 |
| Potassium sorbate | 0.1 | 0.1 | 0.1 | 0.1 | 0.1 | 0.1 | 0.1 |
| Silicon dioxide | 2.0 | 2.0 | 2.0 | 2.0 | 2.0 | 2.0 | 2.0 |
| Total | 100 | 100 | 100 | 100 | 100 | 100 | 100 |

Pouch content: 300 mg total.

The pouch compositions PLC 040-PLC 046 were also made as pouch PLC 040A-PLC 046A each with a pouch content of 200 mg total.

The pouch compositions PLC 040-PLC 046 were also made as pouch PLC 040B-PLC 046B each with a pouch content of 100 mg total.

Wheat fiber, trade name "Vitacel 600 WF plus". Other fibers may be used as well, such as water-insoluble plant fibers, such as oat fibers, pea fibers, rice fiber, maize fibers, oat fibers, tomato fibers, barley fibers, rye fibers, sugar beet fibers, buckwheat fibers, potato fibers, apple fibers, cocoa fibers, powdered cellulose, bran fibers, and bamboo fibers.

Sodium carbonate is used as an alkaline buffering agent. Other buffering agents as described herein may also be used in combination with sodium carbonate or an alternative.

Flavor example, a mixture of e.g. menthol and peppermint may be used. Of course, other flavors as described herein may be use as well, in combination with menthol and/or peppermint or replacing these. The flavor may be liquid or flavored or a combination, i.e. a liquid flavor and a powdered flavor is added.

Acesulfame potassium and/or sucralose may as an example be used as high intensity sweeteners. Other usable high intensity sweeteners described herein may be used in combination with or instead of acesulfame potassium and/or sucralose.

Potassium sorbate is used as a preservative. Other preservatives as described herein may also be used in combination with or instead of potassium sorbate.

Silicon dioxide is used as a glidant. Other possible glidants include e.g. magnesium stearate, starch and talc.

Example 5E: Pouches

The pouch compositions are prepared from the ingredients in table 13 using preparation method described in example 3.

The pouch compositions are filled into pouches as described in example 4 (pouch material of examples 1A was used, but 1B could also have been applied).

TABLE 13

| Pouch compositions. | | | | | | | | | | |
|---|---|---|---|---|---|---|---|---|---|---|
| Pouches | PLC 060 | PLC 061 | PLC 062 | PLC 063 | PLC 064 | PLC 065 | PLC 066 | PLC 067 | PLC 068 | PLC 069 |
| Amount of nicotine | 9.6 mg | 9.6 mg | 9.6 mg | 9.6 mg | 9.6 mg | 9.6 mg | 9.6 mg | 9.6 mg | 9.6 mg | 9.6 mg |
| Water content [wt %] | 29 | 29 | 29 | 29 | 29 | 29 | 29 | 29 | 29 | 34 |
| Raw material | Content in weight percent | | | | | | | | | |
| Premix II | 20.7 | 20.7 | 20.7 | 20.7 | 20.7 | 20.7 | 20.7 | 20.7 | 20.7 | 20.7 |
| Xylitol | 5.0 | — | 5.0 | — | — | — | 5.0 | 5.0 | 5.0 | — |
| Isomalt | — | 13.3 | — | — | — | — | — | 8.3 | — | — |
| Sorbitol | — | — | 8.3 | — | — | — | — | — | — | — |
| Mannitol | — | — | — | 13.3 | — | — | — | — | 8.3 | — |
| Maltitol | — | — | — | — | 13.3 | — | — | — | — | — |
| Erythritol | 8.3 | — | — | — | — | 13.3 | 8.3 | — | — | — |
| Purified water | 22 | 22 | 22 | 22 | 22 | 22 | 22 | 22 | 22 | 27 |
| Wheat fiber | 27 | 27 | 27 | 27 | 27 | 27 | 27 | 27 | 27 | 35 |
| Sodium carbonate | 5.0 | 5.0 | 5.0 | 5.0 | 5.0 | 5.0 | 5.0 | 5.0 | 5.0 | 5.0 |
| Flavor | 8.9 | 8.9 | 8.9 | 8.9 | 8.9 | 8.9 | 8.9 | 8.9 | 8.9 | 9.2 |
| High intensity sweetener | 1.0 | 1.0 | 1.0 | 1.0 | 1.0 | 1.0 | 1.0 | 1.0 | 1.0 | 1.0 |

TABLE 13-continued

| Pouch compositions. | | | | | | | | | | |
|---|---|---|---|---|---|---|---|---|---|---|
| Pouches | PLC 060 | PLC 061 | PLC 062 | PLC 063 | PLC 064 | PLC 065 | PLC 066 | PLC 067 | PLC 068 | PLC 069 |
| Potassium sorbate | 0.1 | 0.1 | 0.1 | 0.1 | 0.1 | 0.1 | 0.1 | 0.1 | 0.1 | 0.1 |
| Silicon dioxide | 2.0 | 2.0 | 2.0 | 2.0 | 2.0 | 2.0 | 2.0 | 2.0 | 2.0 | 2.0 |
| Total | 100 | 100 | 100 | 100 | 100 | 100 | 100 | 100 | 100 | 100 |

Pouch content: 350 mg total.

The pouch compositions PLC 060-PLC 069 were also made as pouch PLC 060A-PLC 069A each with a pouch content of 200 mg total.

The pouch compositions PLC 060-PLC 069 were also made as pouch PLC 060B-PLC 069B each with a pouch content of 100 mg total.

Wheat fiber, trade name "Vitacel 600 WF plus". Other fibers may be used as well, such as water-insoluble plant fibers, such as oat fibers, pea fibers, rice fiber, maize fibers, oat fibers, tomato fibers, barley fibers, rye fibers, sugar beet fibers, buckwheat fibers, potato fibers, apple fibers, cocoa fibers, powdered cellulose, bran fibers, and bamboo fibers.

Potassium sorbate is used as a preservative. Other preservatives as described herein may also be used in combination with or instead of potassium sorbate.

Silicon dioxide is used as a glidant. Other possible glidants include e.g. magnesium stearate, starch and talc.

Example 5F: Pouches

The pouch compositions are prepared from the ingredients in table 14 using preparation method described in example 3.

The pouch compositions are filled into pouches as described in example 4 (pouch material of examples 1A was used, but 1B could also have been applied).

TABLE 14

| Pouch compositions. | | | | | | | | |
|---|---|---|---|---|---|---|---|---|
| Pouches | PLC 080 | PLC 081 | PLC 082 | PLC 083 | PLC 084 | PLC 085 | PLC 086 | PLC 087 |
| Amount of nicotine | 9.6 mg | 9.6 mg | 9.6 mg | 9.6 mg | 9.6 mg | 9.6 mg | 9.6 mg | 9.6 mg |
| Water content [wt %] | 29 | 29 | 29 | 22 | 22 | 37 | 22 | 37 |
| Raw material | Content in weight percent | | | | | | | |
| Premix II | 20.7 | 20.7 | 20.7 | 20.7 | 20.7 | 20.7 | 20.7 | 20.7 |
| Xylitol | 15.2 | 15.2 | 15.2 | 39.2 | 19.2 | 14.2 | 19.2 | 14.2 |
| Purified water | 22 | 22 | 22 | 15 | 15 | 30 | 15 | 30 |
| Wheat fiber | — | — | — | 10 | 30 | 20 | — | — |
| Oat fiber | 27 | — | — | — | — | — | 30 | 20 |
| Pea Fiber | — | 27 | — | — | — | — | — | — |
| Powdered Cellulose | — | — | 27 | — | — | — | — | — |
| Sodium carbonate | 5.0 | 5.0 | 5.0 | 5.0 | 5.0 | 5.0 | 5.0 | 5.0 |
| Flavor | 7.0 | 7.0 | 7.0 | 7.0 | 7.0 | 7.0 | 7.0 | 7.0 |
| High intensity sweetener | 1.0 | 1.0 | 1.0 | 1.0 | 1.0 | 1.0 | 1.0 | 1.0 |
| Potassium sorbate | 0.1 | 0.1 | 0.1 | 0.1 | 0.1 | 0.1 | 0.1 | 0.1 |
| Silicon dioxide | 2.0 | 2.0 | 2.0 | 2.0 | 2.0 | 2.0 | 2.0 | 2.0 |
| Total | 100 | 100 | 100 | 100 | 100 | 100 | 100 | 100 |

Sodium carbonate is used as an alkaline buffering agent. Other buffering agents as described herein may also be used in combination with sodium carbonate or an alternative.

Flavor example, a mixture of e.g. menthol and peppermint may be used. Of course, other flavors as described herein may be use as well, in combination with menthol and/or peppermint or replacing these. The flavor may be liquid or flavored or a combination, i.e. a liquid flavor and a powdered flavor is added.

Acesulfame potassium and/or sucralose may as an example be used as high intensity sweeteners. Other usable high intensity sweeteners described herein may be used in combination with or instead of acesulfame potassium and/or sucralose.

Pouch content: 350 mg total.

The pouch compositions PLC 080-PLC 087 were also made as pouch PLC 080A-PLC 087A each with a pouch content of 200 mg total.

The pouch compositions PLC 080-PLC 087 were also made as pouch PLC 080B-PLC 087B each with a pouch content of 100 mg total.

Wheat fiber, trade name "Vitacel 600 WF plus" or "Vitacel 200WF".

Oat fiber, trade name "Vitacel HF 600".

Pea fiber, trade name "Vitacel EF150".

Powdered Cellulose, trade name "Vitacel L00".

Other fibers may be used as well, such as water-insoluble plant fibers, such as rice fiber, maize fibers, oat fibers, tomato fibers, barley fibers, rye fibers, sugar beet fibers, buckwheat fibers, potato fibers, apple fibers, cocoa fibers, bamboo fibers, and bran fibers.

Sodium carbonate is used as an alkaline buffering agent. Other buffering agents as described herein may also be used in combination with sodium carbonate or an alternative.

Flavor example, a mixture of e.g. menthol and peppermint may be used. Of course, other flavors as described herein may be use as well, in combination with menthol and/or peppermint or replacing these. The flavor may be liquid or flavored or a combination, i.e. a liquid flavor and a powdered flavor is added.

Acesulfame potassium and/or sucralose may as an example be used as high intensity sweeteners. Other usable high intensity sweeteners described herein may be used in combination with or instead of acesulfame potassium and/or sucralose.

Potassium sorbate is used as a preservative. Other preservatives as described herein may also be used in combination with or instead of potassium sorbate.

Silicon dioxide is used as a glidant. Other possible glidants include e.g. magnesium stearate, starch and talc.

Example 5G: Pouches

The pouch compositions are prepared from the ingredients in table 15 using preparation method described in example 3.

The pouch compositions are filled into pouches as described in example 4 (pouch material of examples 1A was used, but 1B could also have been applied).

TABLE 15

Pouch compositions.

| Pouches | PLC 100 | PLC 101 | PLC 102 | PLC 103 | PLC 104 | PLC 105 | PLC 106 | PLC 107 |
|---|---|---|---|---|---|---|---|---|
| Amount of nicotine | 9.6 mg | 9.6 mg | 9.6 mg | 9.6 mg | 9.6 mg | 9.6 mg | 9.6 mg | 9.6 mg |
| Water content [wt %] | 27 | 27 | 27 | 27 | 27 | 30 | 30 | 30 |
| Raw material | Content in weight percent | | | | | | | |
| NPR (16%) | 17.1 | 17.1 | 17.1 | 17.1 | 17.1 | — | — | — |
| Premix VI | — | — | — | — | — | 9.1 | 9.1 | 9.1 |
| Xylitol | 11.9 | 14.4 | 6.9 | 9.9 | 9.9 | 24.9 | 17.9 | 17.9 |
| Purified water | 27 | 27 | 27 | 27 | 27 | 27 | 27 | 27 |
| Wheat fiber | 27 | 27 | 27 | 27 | 27 | 27 | 27 | 27 |
| Sodium carbonate | 5.0 | 2.5 | 10.0 | 3.5 | — | — | 3.5 | — |
| Sodium hydrogencarbonate | — | — | — | 3.5 | — | — | 3.5 | — |
| Trometamol | — | — | — | — | 7.0 | — | — | 7.0 |
| Flavor | 8.9 | 8.9 | 8.9 | 8.9 | 8.9 | 8.9 | 8.9 | 8.9 |
| High intensity sweetener | 1.0 | 1.0 | 1.0 | 1.0 | 1.0 | 1.0 | 1.0 | 1.0 |
| Potassium sorbate | 0.1 | 0.1 | 0.1 | 0.1 | 0.1 | 0.1 | 0.1 | 0.1 |
| Silicon dioxide | 2.0 | 2.0 | 2.0 | 2.0 | 2.0 | 2.0 | 2.0 | 2.0 |
| Total | 100 | 100 | 100 | 100 | 100 | 100 | 100 | 100 |

Pouch content: 350 mg total.

The pouch compositions PLC 100-PLC 107 were also made as pouch PLC 100A-PLC 107A each with a pouch content of 200 mg total.

The pouch compositions PLC 100-PLC 107 were also made as pouch PLC 100B-PLC 107B each with a pouch content of 100 mg total.

Wheat fiber, trade name "Vitacel 600 WF plus". Other fibers may be used as well, such as water-insoluble plant fibers, such as oat fibers, pea fibers, rice fiber, maize fibers, oat fibers, tomato fibers, barley fibers, rye fibers, sugar beet fibers, buckwheat fibers, potato fibers, apple fibers, cocoa fibers, powdered cellulose, bran fibers, and bamboo fibers.

Sodium carbonate, sodium hydrogen carbonate and/or trometamol are used as an alkaline buffering agent. Other buffering agents as described herein may also be used in combination with sodium carbonate or an alternative.

Flavor example, a mixture of e.g. menthol and peppermint may be used. Of course, other flavors as described herein may be use as well, in combination with menthol and/or peppermint or replacing these. The flavor may be liquid or flavored or a combination, i.e. a liquid flavor and a powdered flavor is added.

Acesulfame potassium and/or sucralose may as an example be used as high intensity sweeteners. Other usable high intensity sweeteners described herein may be used in combination with or instead of acesulfame potassium and/or sucralose.

Potassium sorbate is used as a preservative. Other preservatives as described herein may also be used in combination with or instead of potassium sorbate.

Silicon dioxide is used as a glidant. Other possible glidants include e.g. magnesium stearate, starch and talc.

Example 5H: Pouch Weight

The pouch compositions are prepared from the ingredients in table 16 using preparation method described in example 3.

The pouch compositions are filled into pouches as described in example 4 (pouch material of examples 1A was used, but 1B could also have been applied).

TABLE 16

| Pouch compositions. | | | |
|---|---|---|---|
| | Pouches | | |
| | PLC110 | PLC111 | PLC112 |
| Amount of nicotine | 6.4 mg | 6.4 mg | 6.4 mg |
| Water content [wt %] | 29 | 29 | 30 |
| Pouch weight [mg] | 400 | 265 | 135 |
| Raw material | Content in weight percent | | |
| Premix II | 12.1 | 18.3 | 35.9 |
| Xylitol | 5 | 4.6 | 3.5 |

TABLE 16-continued

| Pouch compositions. | | | |
|---|---|---|---|
| | Pouches | | |
| | PLC110 | PLC111 | PLC112 |
| Erythritol | 20.4 | 18.6 | 14.1 |
| Purified water | 25 | 23 | 18 |
| Wheat fiber | 30 | 28 | 21 |
| Sodium carbonate | 3.0 | 3.0 | 3.0 |
| Flavor | 2.5 | 2.5 | 2.5 |
| Silicon dioxide | 2.0 | 2.0 | 2.0 |
| Total | 100 | 100 | 100 |

Pouch content: 400 mg total unless otherwise specifically indicated in the table.

Wheat fiber, trade name "Vitacel 600 WF plus". Other fibers may be used as well, such as water-insoluble plant fibers, such as oat fibers, pea fibers, rice fiber, maize fibers, oat fibers, tomato fibers, barley fibers, rye fibers, sugar beet fibers, buckwheat fibers, potato fibers, apple fibers, cocoa fibers, powdered cellulose, bran fibers, and bamboo fibers.

Sodium carbonate is used as an alkaline buffering agent. Other buffering agents as described herein may also be used in combination with sodium carbonate or an alternative.

Flavor example, a mixture of e.g. menthol and peppermint may be used. Of course, other flavors as described herein may be use as well, in combination with menthol and/or peppermint or replacing these. The flavor may be liquid or flavored or a combination, i.e. a liquid flavor and a powdered flavor is added.

Silicon dioxide is used as a glidant. Other possible glidants include e.g. magnesium stearate, starch and talc.

Example 51: Pouches

The pouch compositions are prepared from the ingredients in table 17A using preparation method described in example 3.

The pouch compositions are filled into pouches as described in example 4 (pouch material of examples 1A was used, but 1B could also have been applied).

TABLE 17A

| Pouch compositions. | | | | | | |
|---|---|---|---|---|---|---|
| Pouches | PLC 120 | PLC 121 | PLC 122 | PLC 123 | PLC 124 | PLC 125 |
| Amount of nicotine | 2.0 mg | 2.0 mg | 2.0 mg | 2.0 mg | 2.0 mg | 2.0 mg |
| Water content [wt %] | 5 | — | 5 | — | 5 | — |
| Raw material | Content in weight percent | | | | | |
| Premix VI | 16.7 | — | 16.7 | — | 16.7 | — |
| Nicotine salt | — | 15.0 | — | 15.0 | — | 15.0 |
| Wheat fiber | 67 | 68 | — | — | — | — |
| Oat fiber | — | — | 67 | 68 | — | — |
| Powdered Cellulose | — | — | — | — | 67 | 68 |
| Sodium carbonate | 2.5 | 2.5 | 2.5 | 2.5 | 2.5 | 2.5 |
| Flavor | 5.6 | 6.3 | 5.6 | 6.3 | 5.6 | 6.3 |
| High intensity sweetener | 0.2 | 0.2 | 0.2 | 0.2 | 0.2 | 0.2 |
| Alginate | 7.0 | 7.0 | 7.0 | 7.0 | 7.0 | 7.0 |
| Silicon dioxide | 1.0 | 1.0 | 1.0 | 1.0 | 1.0 | 1.0 |
| Total | 100 | 100 | 100 | 100 | 100 | 100 |

Pouch content: 40 mg total.

The pouch compositions PLC 120-PLC 125 were also made as pouch PLC 120A-PLC 125A each with a pouch content of 80 mg total.

The pouch compositions PLC 120-PLC 125 were also made as pouch PLC 120B-PLC 125B each with a pouch content of 120 mg total.

Nicotine salt used is nicotine bitartrate. Other nicotine salts as described herein may also be used in combination with nicotine bitartrate or as an alternative.

Wheat fiber, trade name "Vitacel 600 WF plus" or "Vitacel 200WF".

Oat fiber, trade name "Vitacel HF 600".

Powdered Cellulose, trade name "Vitacel L00".

Other fibers may be used as well, such as water-insoluble plant fibers, such as pea fibers, rice fiber, maize fibers, oat fibers, tomato fibers, barley fibers, rye fibers, sugar beet fibers, buckwheat fibers, potato fibers, apple fibers, cocoa fibers, bamboo fibers, and bran fibers.

Sodium carbonate is used as an alkaline buffering agent. Other buffering agents as described herein may also be used in combination with sodium carbonate or an alternative.

Flavor example, a mixture of e.g. menthol and peppermint may be used. Of course, other flavors as described herein may be use as well, in combination with menthol and/or peppermint or replacing these. The flavor may be liquid or flavored or a combination, i.e. a liquid flavor and a powdered flavor is added.

Acesulfame potassium and/or sucralose may as an example be used as high intensity sweeteners. Other usable high intensity sweeteners described herein may be used in combination with or instead of acesulfame potassium and/or sucralose.

Alginate, such as sodium alginate, is used as a humectant. Other humectants as described herein may also be used in combination with or instead of sodium alginate.

Silicon dioxide is used as a glidant. Other possible glidants include e.g. magnesium stearate, starch and talc.

Pouch compositions are prepared from the ingredients in table 17B using preparation method described in example 3.

The pouch compositions are filled into pouches as described in example 4 (pouch material of examples 1A was used, but 1B could also have been applied).

TABLE 17B

| Pouch compositions. | | | | |
|---|---|---|---|---|
| Pouches | PLC 126 | PLC 127 | PLC 128 | PLC 129 |
| Amount of nicotine | 2.0 mg | 1.0 mg | 1.0 mg | 1.0 mg |
| Water content [wt %] | — | — | — | — |
| Raw material | | | | |
| Nicotine free base | 5.0 | 2.5 | 2.5 | — |
| NPR (20%) | — | — | — | 12.5 |
| Powdered Cellulose | 68 | 73 | | |
| Microcrystalline Cellulose | — | — | 73 | 63 |
| Sodium carbonate | 2.5 | 2.0 | 2.0 | 2.0 |
| Flavor | 6.5 | 6.0 | 6.0 | 6.0 |
| Copovidone | 10 | 10 | 10 | 10 |
| Alginate | 7.0 | 5.5 | 5.5 | 5.5 |
| Silicon dioxide | 1.0 | 1.0 | 1.0 | 1.0 |
| Total | 100 | 100 | 100 | 100 |

Pouch content: 40 mg total.

The pouch compositions PLC 126-PLC 129 were also made as pouch PLC 126A-PLC 129A each with a pouch content of 80 mg total.

The pouch compositions PLC 126-PLC 129 were also made as pouch PLC 126B-PLC 129B each with a pouch content of 120 mg total.

Nicotine free base is available from Siegfried. When nicotine free base is applied, it is premixed with one or more powdered ingredients, preferably cellulose and/or alginate. NPR (20%) denotes nicotine polacrilex resin complex with a nicotine load of 20% by weight of the NPR complex.

Powdered Cellulose, trade name "Vitacel L00".

Microcrystalline Cellulose (MCC), trade name "Avicel PH-102".

Other fibers may be used as well, such as water-insoluble plant fibers, such as oat fibers, pea fibers, rice fiber, maize fibers, wheat fibers, tomato fibers, barley fibers, rye fibers, sugar beet fibers, buckwheat fibers, potato fibers, apple fibers, cocoa fibers, bamboo fibers, and bran fibers.

Sodium carbonate is used as an alkaline buffering agent. Other buffering agents as described herein may also be used in combination with sodium carbonate or an alternative.

Flavor example, a mixture of e.g. menthol and peppermint may be used. Of course, other flavors as described herein may be use as well, in combination with menthol and/or peppermint or replacing these. The flavor may be liquid or flavored or a combination, i.e. a liquid flavor and a powdered flavor is added.

Acesulfame potassium and/or sucralose may optionally be used as high intensity sweeteners. Other usable high intensity sweeteners described herein may be used in combination with or instead of acesulfame potassium and/or sucralose.

Copovidone, trade name "Kollidon VA 64"

Silicon dioxide is used as a glidant. Other possible glidants include e.g. magnesium stearate, starch and talc.

Example 5J: Pouch Compositions

The pouch compositions are prepared from the ingredients in table 18A using preparation method described in example 3.

TABLE 18A

| Pouch compositions. | | | | | | |
|---|---|---|---|---|---|---|
| Pouch compositions | PLC 130 | PLC 131 | PLC 132 | PLC 133 | PLC 134 | PLC 135 |
| Water content [wt %] | 29 | 29 | 29 | 29 | 29 | 29 |
| Raw material | Content in weight percent | | | | | |
| Premix II | 12.6 | 12.6 | 12.6 | 12.6 | 12.6 | 12.6 |
| Erythritol | 23.8 | 23.8 | 23.8 | 23.8 | 23.8 | 23.8 |
| Purified water | 25.0 | 25.0 | 25.0 | 25.0 | 25.0 | 25.0 |
| Oat fiber | 30.0 | — | — | — | — | — |
| Powdered cellulose | — | 30.0 | — | — | — | — |
| MCC | — | — | 30.0 | — | — | — |
| Bamboo fiber | — | — | — | 30.0 | — | — |
| Wheat fiber | — | — | — | — | 30.0 | — |
| Potato fiber | — | — | — | — | — | 30.0 |
| Sodium carbonate | 3.0 | 3.0 | 3.0 | 3.0 | 3.0 | 3.0 |
| Flavor | 2.5 | 2.5 | 2.5 | 2.5 | 2.5 | 2.5 |
| Alginate | 1.0 | 1.0 | 1.0 | 1.0 | 1.0 | 1.0 |
| Potassium sorbate | 0.1 | 0.1 | 0.1 | 0.1 | 0.1 | 0.1 |
| Silicon dioxide | 2.0 | 2.0 | 2.0 | 2.0 | 2.0 | 2.0 |
| Total | 100 | 100 | 100 | 100 | 100 | 100 |

MCC = microcrystalline cellulose

Wheat fiber, trade name "Vitacel 600 WF plus" or "Vitacel 200WF".

Oat fiber, trade name "Vitacel HF 600".

Powdered Cellulose, trade name "Vitacel L00".

Microcrystalline Cellulose, trade name "Avicel PH-102".

Bamboo fiber, trade name "Vitacel BAF 90".

Potato fiber, trade name "Vitacel KF 200".

Other fibers may be used as well, such as water-insoluble plant fibers, such as pea fibers, rice fiber, maize fibers, tomato fibers, barley fibers, rye fibers, sugar beet fibers, buckwheat fibers, apple fibers, cocoa fibers, and bran fibers.

Sodium carbonate is used as an alkaline buffering agent. Other buffering agents as described herein may also be used in combination with sodium carbonate or an alternative.

Flavor example, a mixture of e.g. menthol and peppermint may be used. Of course, other flavors as described herein may be use as well, in combination with menthol and/or peppermint or replacing these. The flavor may be liquid or flavored or a combination, i.e. a liquid flavor and a powdered flavor is added.

Acesulfame potassium and/or sucralose may optionally be used as high intensity sweeteners. Other usable high intensity sweeteners described herein may be used in combination with or instead of acesulfame potassium and/or sucralose.

Alginate, such as sodium alginate, is used as a humectant. Other humectants as described herein may also be used in combination with or instead of sodium alginate.

Potassium sorbate is used as a preservative. Other preservatives as described herein may also be used in combination with or instead of potassium sorbate.

Silicon dioxide is used as a glidant. Other possible glidants include e.g. magnesium stearate, starch and talc.

Example 5K: Pouches

The pouch compositions are prepared from the ingredients in table 18B using preparation method described in example 3.

The pouch compositions are filled into pouches as described in example 4 (pouch material of examples 1A was used, but 1B could also have been applied) using a fixed pouch surface area of 29×15 $mm^2$, and using the pouch weights specified in below table 18B.

TABLE 18B

Pouch compositions.

| | Pouch compositions | | |
|---|---|---|---|
| | PLC 140 | PLC 141 | PLC 142 |
| Amount of nicotine | 4.2 mg | 4.2 mg | 4.2 mg |
| Water content [wt %] | 36 | 29 | 27 |
| Pouch weight [mg] | 100 | 300 | 600 |
| Raw material | Content in weight percent | | |
| Premix II | 31.8 | 10.6 | 5.3 |
| Erythritol | 4.2 | 25.4 | 30.7 |
| Purified water | 25 | 25 | 25 |
| Oat fiber | 30 | 30 | 30 |
| Sodium carbonate | 3.0 | 3.0 | 3.0 |
| Flavor | 2.5 | 2.5 | 2.5 |
| HIS | 0.4 | 0.4 | 0.4 |
| Alginate | 1.0 | 1.0 | 1.0 |
| Potassium sorbate | 0.1 | 0.1 | 0.1 |
| Silicon dioxide | 2.0 | 2.0 | 2.0 |
| Total | 100 | 100 | 100 |

Oat fiber, trade name "Vitacel HF 600".

Other fibers may be used as well, such as water-insoluble plant fibers, such as wheat fibers, pea fibers, rice fiber, maize fibers, tomato fibers, barley fibers, rye fibers, sugar beet fibers, buckwheat fibers, potato fibers, powdered cellulose, apple fibers, cocoa fibers, bamboo fibers, and bran fibers.

Sodium carbonate is used as an alkaline buffering agent. Other buffering agents as described herein may also be used in combination with sodium carbonate or an alternative.

Flavor example, a mixture of e.g. menthol and peppermint may be used. Of course, other flavors as described herein may be use as well, in combination with menthol and/or peppermint or replacing these. The flavor may be liquid or flavored or a combination, i.e. a liquid flavor and a powdered flavor is added.

Acesulfame potassium and/or sucralose may optionally be used as high intensity sweeteners (HIS). Other usable high intensity sweeteners described herein may be used in combination with or instead of acesulfame potassium and/or sucralose.

Alginate, such as sodium alginate, is used as a humectant. Other humectants as described herein may also be used in combination with or instead of sodium alginate.

Potassium sorbate is used as a preservative. Other preservatives as described herein may also be used in combination with or instead of potassium sorbate.

Silicon dioxide is used as a glidant. Other possible glidants include e.g. magnesium stearate, starch and talc.

Example 5L: Pouches

Pouches were made using pouch compositions of example 5I and 5J. The pouch compositions are filled into pouches as described in example 4 (pouch material of examples 1A was used, but 1B could also have been applied), except that the target weight of the pouches was set as indicated below.

In table 19-21 below, the pouch area and/or the amount of pouch composition is varied.

Figure 15A:
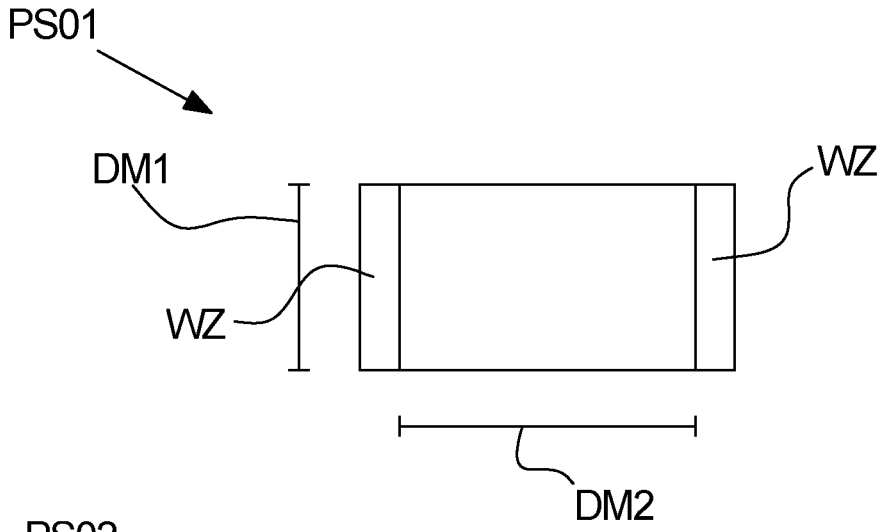
FIG. 15A-15C illustrates pouches with different pouch areas.
Figure 15B:
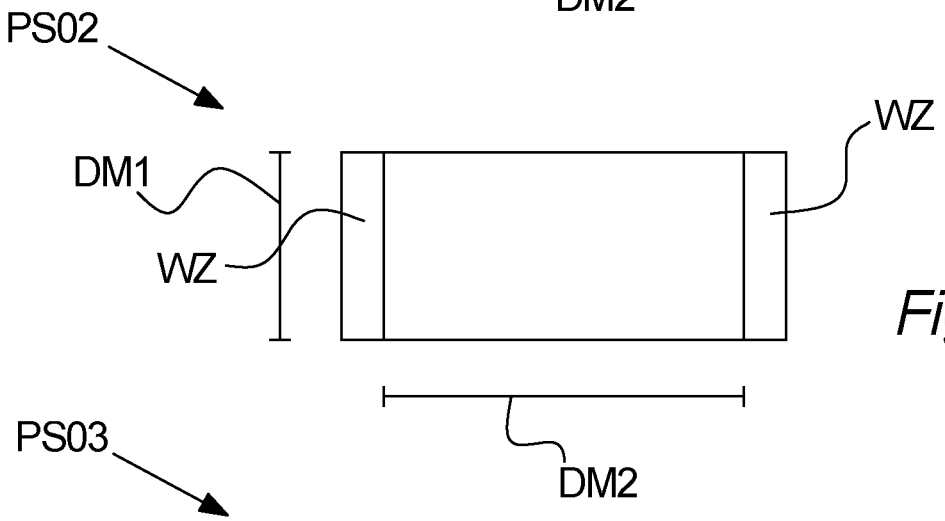
Figure 15C:
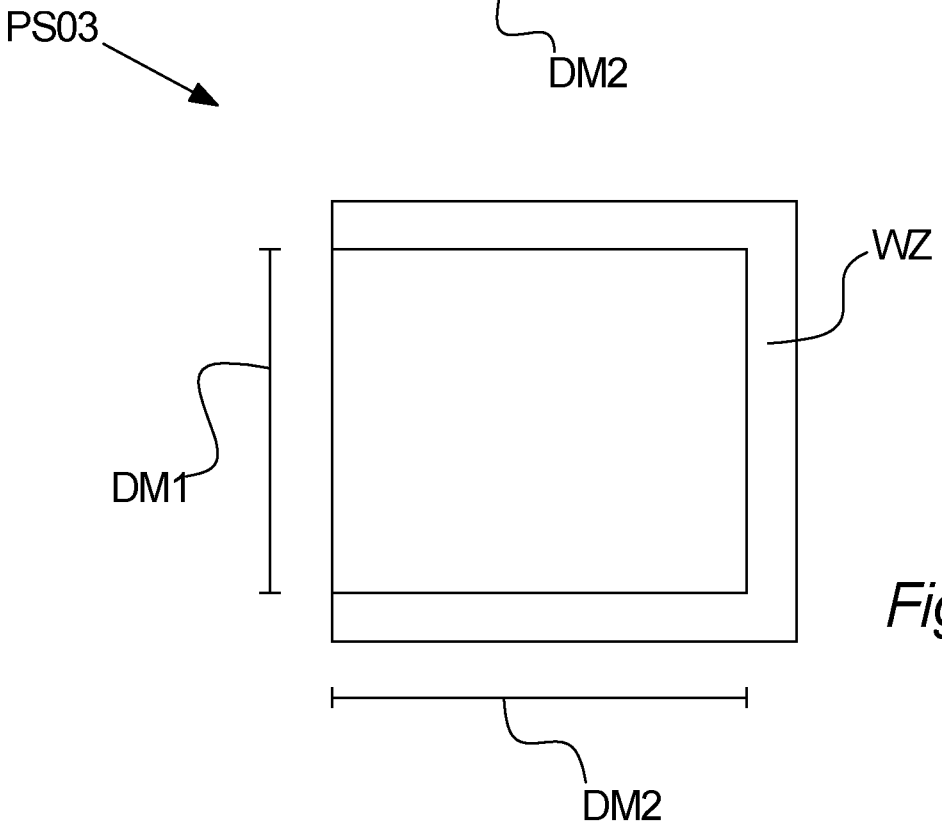

The pouch area is the area of the pouch before filling, where the pouch before filling comprises two pouch membrane sections (may in some embodiments be referred to as two fleece sections), e.g. as an upper and a lower pouch membrane section, joined to form an inner pouch volume into which the pouch composition is inserted, and where the pouch area refers to the dimensions of one of the two pouch membrane sections. Pouches PS01-PS03 with varying pouch areas are illustrated in FIGS. 15A-15C. As shown, the area is gradually increasing from FIG. 15A to 15C. Each pouch is sealed by one or more welding zones WZ or suitable sealing zones. For FIGS. 15A-15C, the dimensions DM1, DM2 referred to as forming the pouch area are illustrated. It is noted that the welding zones do not form part of the pouch area. The pouch area in the below tables 19-21 corresponds to DM1×DM2.

Pouches were made with varying pouch areas, in accordance with below table 19.

The amount of used pouch composition, 400 mg, was kept constant for the pouches of table 19. Thus, a nicotine amount of 6.6 mg of each pouch was obtained.

TABLE 19

Pouches with corresponding pouch compositions, pouch area, and amount of nicotine.

| Pouch | Composition used | Pouch area [mm2] | Amount of nicotine |
|---|---|---|---|
| PLC130-1 | PLC130 | 22 × 15 | 6.6 mg |
| PLC130-2 | PLC130 | 29 × 15 | 6.6 mg |
| PLC130-3 | PLC130 | 32 × 27 | 6.6 mg |
| PLC131-1 | PLC131 | 22 × 15 | 6.6 mg |
| PLC131-2 | PLC131 | 29 × 15 | 6.6 mg |
| PLC131-3 | PLC131 | 32 × 27 | 6.6 mg |
| PLC132-1 | PLC132 | 22 × 15 | 6.6 mg |
| PLC132-2 | PLC132 | 29 × 15 | 6.6 mg |

Pouches were made with varying amount of pouch composition and a fixed surface area of 29×15 $mm^2$, in accordance with below table 20. The resulting varying amount of nicotine for each pouch is indicated in table 20.

TABLE 20

Pouches with corresponding pouch compositions, amount of pouch composition, and amount of nicotine.

| Pouch | Composition used | Amount pouch composition [mg] | Pouch area [mm2] | Amount of nicotine |
|---|---|---|---|---|
| PLC130-A | PLC130 | 100 | 29 × 15 | 1.7 mg |
| PLC130-B | PLC130 | 300 | 29 × 15 | 5.0 mg |
| PLC130-C | PLC130 | 600 | 29 × 15 | 10.0 mg |
| PLC131-A | PLC131 | 100 | 29 × 15 | 1.7 mg |
| PLC131-B | PLC131 | 300 | 29 × 15 | 5.0 mg |
| PLC131-C | PLC131 | 600 | 29 × 15 | 10.0 mg |

TABLE 20-continued

Pouches with corresponding pouch compositions, amount of pouch composition, and amount of nicotine.

| Pouch | Composition used | Amount pouch composition [mg] | Pouch area [mm2] | Amount of nicotine |
|---|---|---|---|---|
| PLC132-A | PLC132 | 100 | 29 × 15 | 1.7 mg |
| PLC132-B | PLC132 | 300 | 29 × 15 | 5.0 mg |
| PLC132-C | PLC132 | 600 | 29 × 15 | 10.0 mg |
| PLC133-A | PLC133 | 100 | 29 × 15 | 1.7 mg |
| PLC133-C | PLC133 | 600 | 29 × 15 | 10.0 mg |
| PLC134-A | PLC134 | 100 | 29 × 15 | 1.7 mg |
| PLC134-C | PLC134 | 600 | 29 × 15 | 10.0 mg |
| PLC135-A | PLC135 | 100 | 29 × 15 | 1.7 mg |
| PLC135-C | PLC135 | 600 | 29 × 15 | 10.0 mg |
| PLC126A-X | PLC126A | 80 | 30 × 8.6 | 4.0 mg |

Pouches were made with varying amount of total pouch composition and simultaneously varying pouch areas, in accordance with below table 21. Thereby, the degree of filling of the pouches was kept approximately constant for a fixed pouch composition regardless of the variation of amount of pouch composition used in the pouches.

The resulting varying amount of nicotine for each pouch as indicated in table 21.

TABLE 21

Pouches with corresponding pouch compositions, amount of pouch composition, pouch area, and amount of nicotine.

| Pouch | Composition used | Amount pouch composition [mg] | Pouch area [mm2] | Amount of nicotine |
|---|---|---|---|---|
| PLC130-I | PLC130 | 200 | 15 × 15 | 3.3 mg |
| PLC130-II | PLC130 | 400 | 21 × 15 | 6.6 mg |
| PLC130-III | PLC130 | 600 | 29 × 15 | 10.0 mg |
| PLC131-I | PLC131 | 200 | 15 × 15 | 3.3 mg |
| PLC131-II | PLC131 | 400 | 21 × 15 | 6.6 mg |
| PLC131-III | PLC131 | 600 | 29 × 15 | 10.0 mg |
| PLC132-I | PLC132 | 200 | 15 × 15 | 3.3 mg |
| PLC132-II | PLC132 | 400 | 21 × 15 | 6.6 mg |

Examples 6: Release of Nicotine

Pouches PLC110, PLC111, and PLC112 were subjected to tests to measure nicotine release.

Test Method

10 L chewing buffer pH 7.4 was degassed and heated to 38° C. with a Dissolution Media Preparation Station.

900 mL chewing buffer pH 7.4 was transferred to each vessel in the USP Dissolution Apparatus 1. Inside the vessels, the chewing buffer pH 7.4 was adjusted to 37° C.

Weight measured pouches were transferred to baskets and the dissolution apparatus was started.

Sampling times of buffer were set to different times, occasionally covering the time span of different times such as 2, 6, 12, 20, 30 and 60 min. Rotational speed was set to 100 rpm.

Release samples after 2 min were taken manually with cannulas. Release samples at all time points were taken automatically with the dissolution apparatus.

All samples were filtered and prepared for HPLC analysis.

For each sample release measurements were repeated for 6 individual pouches.

Results

The measured nicotine release profiles are shown in table 22.

TABLE 22

Nicotine release profiles showing release of nicotine in % of total nicotine content. Values of table 22 are shown in FIG. 1.

| Time minutes | Pouches | | |
|---|---|---|---|
| | PLC110 | PLC111 | PLC112 |
| | Release of nicotine in percentage of total nicotine content | | |
| 2 | 15.4 | 23.3 | 31.1 |
| 6 | 25.0 | 33.6 | 47.0 |
| 12 | 35.0 | 45.6 | 59.3 |
| 20 | 45.5 | 56.9 | 69.7 |
| 30 | 55.6 | 67.7 | 79.4 |
| 60 | 75.4 | 85.2 | 94.0 |

As shown in FIG. 1 and table 22, PLC110-112 showed gradually better release of nicotine, with PLC112 having the fastest nicotine release. This illustrates the unexpected finding that lowering the amount of pouch substrate facilitates a faster release of nicotine.

Example 7: Release of Nicotine

Various pouches were subjected to tests to measure nicotine release by application of a test method resembling that of Example 6.

Test Method

10 L chewing buffer pH 7.4 was degassed and heated to 38° C. with a Dissolution Media Preparation Station.

900 mL chewing buffer pH 7.4 was transferred to each vessel in the USP Dissolution Apparatus 1. Inside the vessels, the chewing buffer pH 7.4 was adjusted to 37° C.

Weight measured pouches were transferred to baskets and the dissolution apparatus was started.

Sampling times of buffer were set to different times, occasionally covering the time span of different times such as 7, 14, 21, and 30 min. Rotational speed was set to 100 rpm.

Release samples at all time points were taken automatically with the dissolution apparatus.

All samples were filtered and prepared for HPLC analysis.

For each sample release measurements were repeated for 6 individual pouches at each time point. Results are shown as averages of the results for the 6 individual pouches.

Results

Various samples with constant amount of pouch composition and different pouch surface area as outlined in Example 5L, table 19 were measured.

The measured nicotine release profiles are shown in table 23.

TABLE 23

| Nicotine release profiles showing release of nicotine in % of total nicotine content. | | | | | | |
|---|---|---|---|---|---|---|
| Pouches | PLC 130-1 | PLC 130-2 | PLC 130-3 | PLC 131-1 | PLC 131-2 | PLC 131-3 |
| Time (minutes) | Release of nicotine in percentage of total nicotine content | | | | | |
| 7 | 16 | 19 | 40 | 33 | 48 | 72 |
| 14 | 25 | 29 | 55 | 48 | 67 | 86 |
| 21 | 32 | 37 | 65 | 56 | 76 | 93 |
| 30 | 40 | 45 | 73 | 64 | 83 | 97 |

Figure 2:
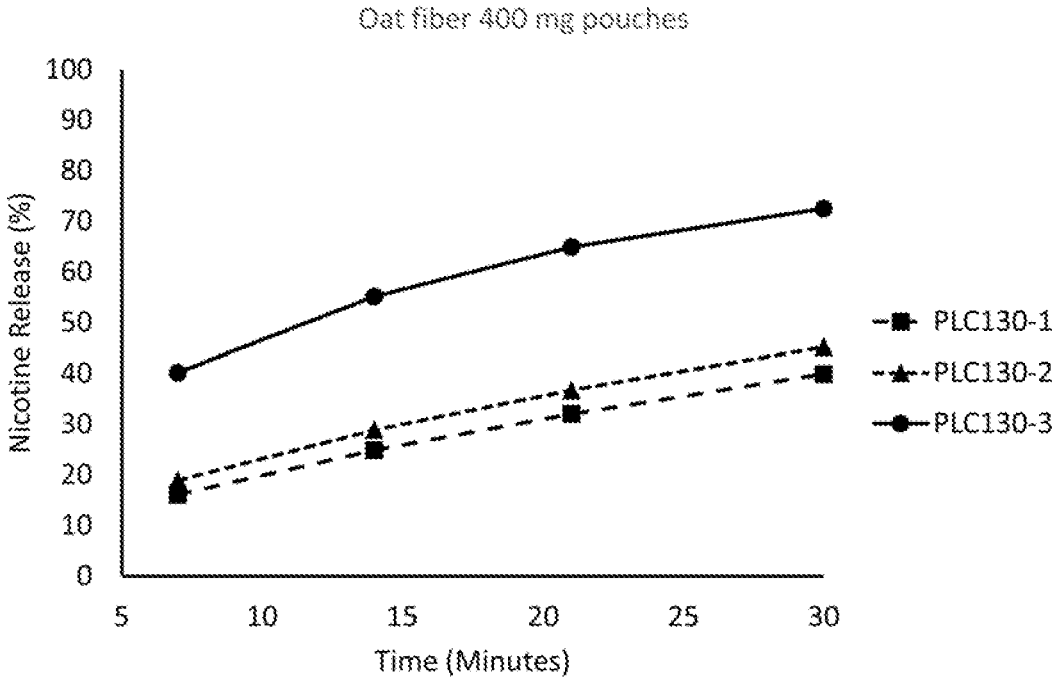
FIGS. 2-3 illustrate fast nicotine release according to example 7.

Nicotine release profiles for PLC130-1, PLC130-2, and PLC130-3 are shown in FIG. 2.

Figure 3:
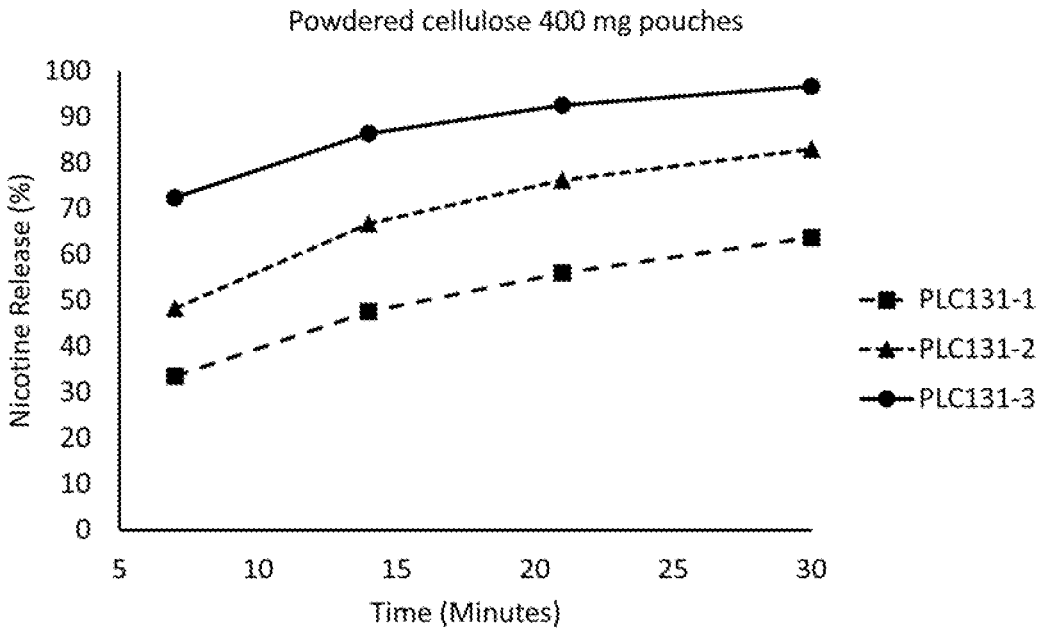

Nicotine release profiles for PLC131-1, PLC131-2, and PLC131-3 are shown in FIG. 3.

As can be seen from table 23 and FIGS. 2-3, increasing the pouch area unexpectedly increases nicotine release from the pouch. This can be observed for pouches based on oat fiber containing PLC130 pouch composition as well as powdered cellulose containing PLC131 pouch composition. Also, it can be observed that especially for powdered cellulose containing PLC131 pouch composition, very high degree of nicotine release may be obtained.

Example 8: Release of Nicotine

Various pouches were subjected to tests to measure nicotine release.

Test Method

The method of example 7 was used.

Results

Various samples with different amount of pouch composition and constant pouch surface area as outlined in Ex 5L, table 20 were measured.

The measured nicotine release profiles are shown in tables 24 and 25.

TABLE 24

| Nicotine release profiles showing release of nicotine in % of total nicotine content. | | | | | | | | | |
|---|---|---|---|---|---|---|---|---|---|
| Pouches | PLC 130-A | PLC 130-B | PLC 130-C | PLC 131-A | PLC 131-B | PLC 131-C | PLC 132-A | PLC 132-B | PLC 132-C |
| Time (minutes) | Release of nicotine in percentage of total nicotine content | | | | | | | | |
| 7 | 76 | 35 | 20 | 92 | 65 | 50 | 93 | 49 | 38 |
| 14 | 89 | 49 | 30 | 99 | 81 | 68 | 99 | 67 | 53 |
| 21 | 96 | 58 | 37 | 100 | 88 | 78 | 100 | 78 | 63 |
| 30 | 100 | 66 | 45 | 100 | 93 | 86 | 100 | 84 | 73 |

Figure 4:
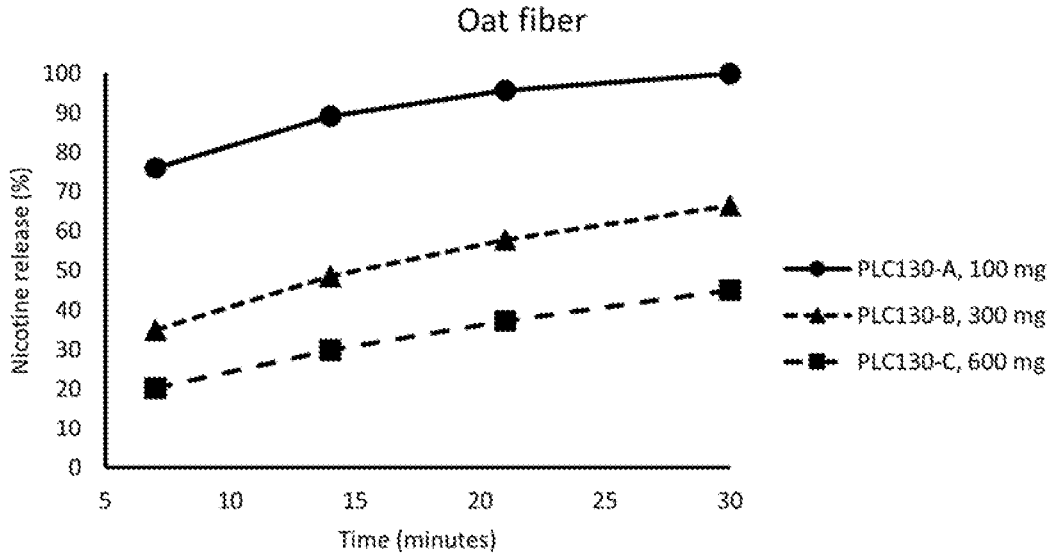
FIGS. 4-9 illustrate fast nicotine release according to example 8.

Nicotine release profiles for PLC130-A, PLC130-B, and PLC130-C are shown in FIG. 4.

Figure 5:
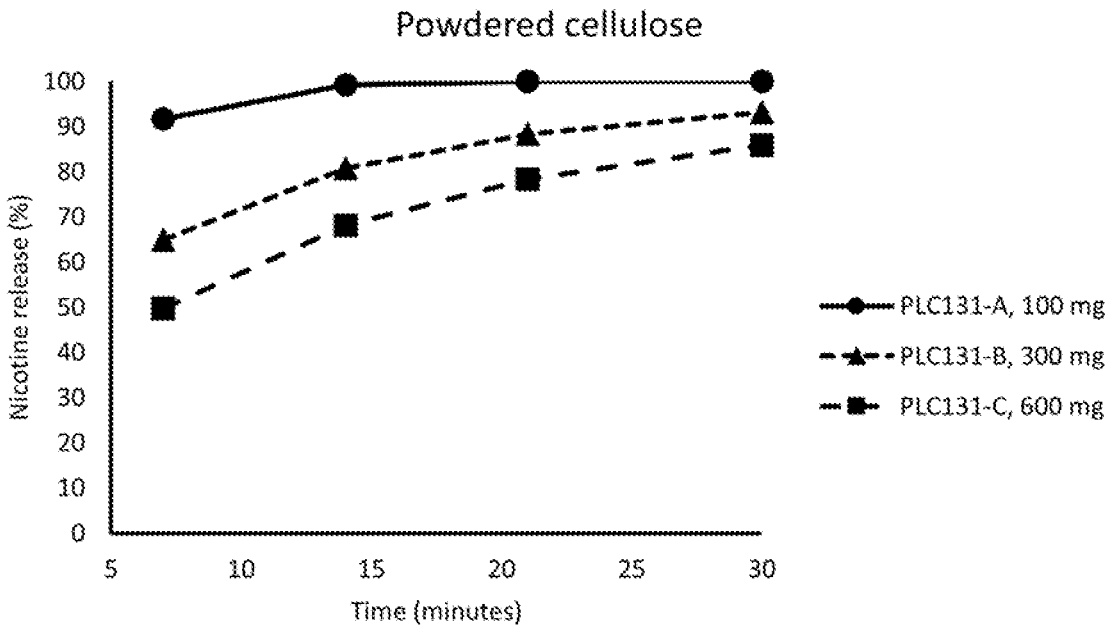

Nicotine release profiles for PLC131-A, PLC131-B, and PLC131-C are shown in FIG. 5.

Figure 6:
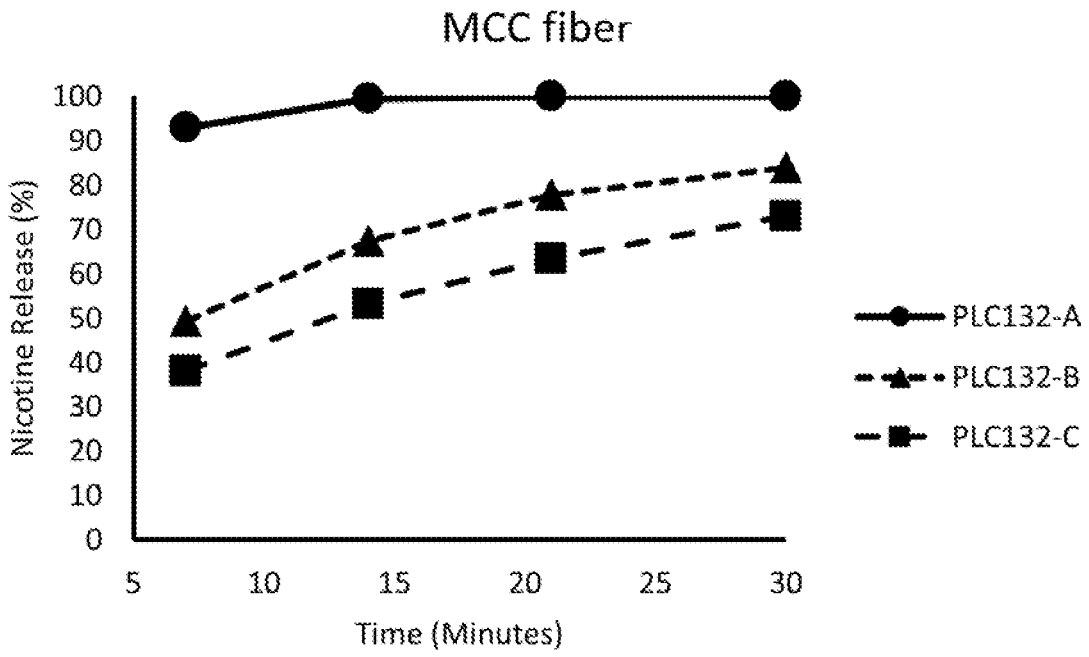

Nicotine release profiles for PLC132-A, PLC132-B, and PLC132-C are shown in FIG. 6.

As can be seen from table 24 and FIGS. 4-6, lowering the amount of pouch composition unexpectedly increases the relative nicotine release from the pouch. This can be observed for pouches based on oat fiber containing PLC130 pouch composition, powdered cellulose containing PLC131 pouch composition, as well as MCC containing PLC132 pouch composition. Also, it can be observed that very high degree of nicotine release may be obtained.

TABLE 25

| Nicotine release profiles showing release of nicotine in % of total nicotine content. | | | | | | |
|---|---|---|---|---|---|---|
| Pouches | PLC 133-A | PLC 133-C | PLC 134-A | PLC 134-C | PLC 135-A | PLC 135-C |
| Time (minutes) | Release of nicotine in percentage of total nicotine content | | | | | |
| 7 | 82 | 19 | 79 | 20 | 90 | 20 |
| 14 | 91 | 30 | 91 | 29 | 97 | 30 |
| 21 | 92 | 38 | 96 | 37 | 98 | 38 |
| 30 | 93 | 47 | 99 | 44 | N/A | 47 |

N/A = not measured.

Figure 7:
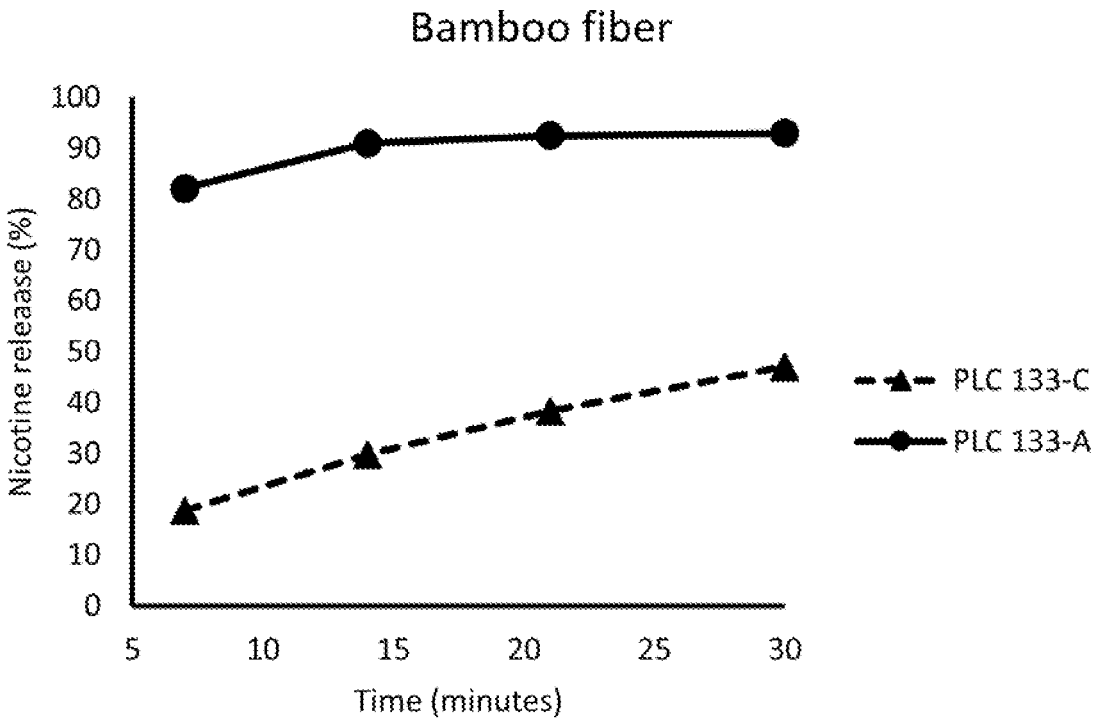

Nicotine release profiles for PLC133-A and PLC133-C are shown in FIG. 7.

Figure 8:
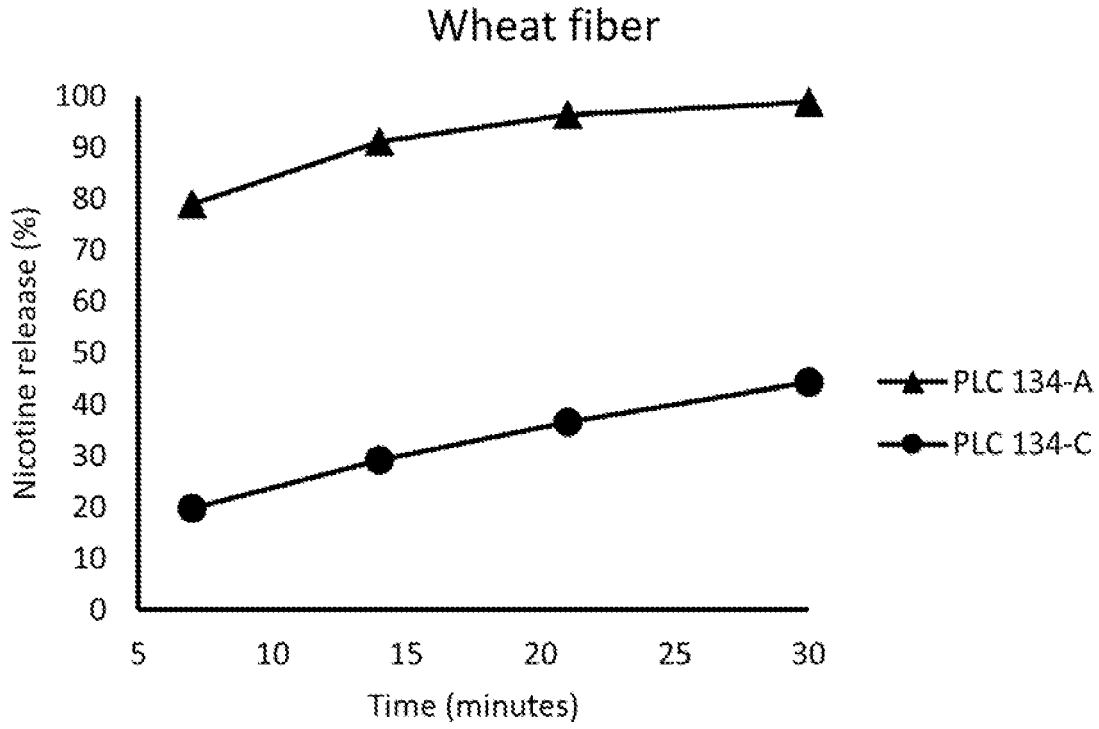

Nicotine release profiles for PLC134-A and PLC134-C are shown in FIG. 8.

Figure 9:
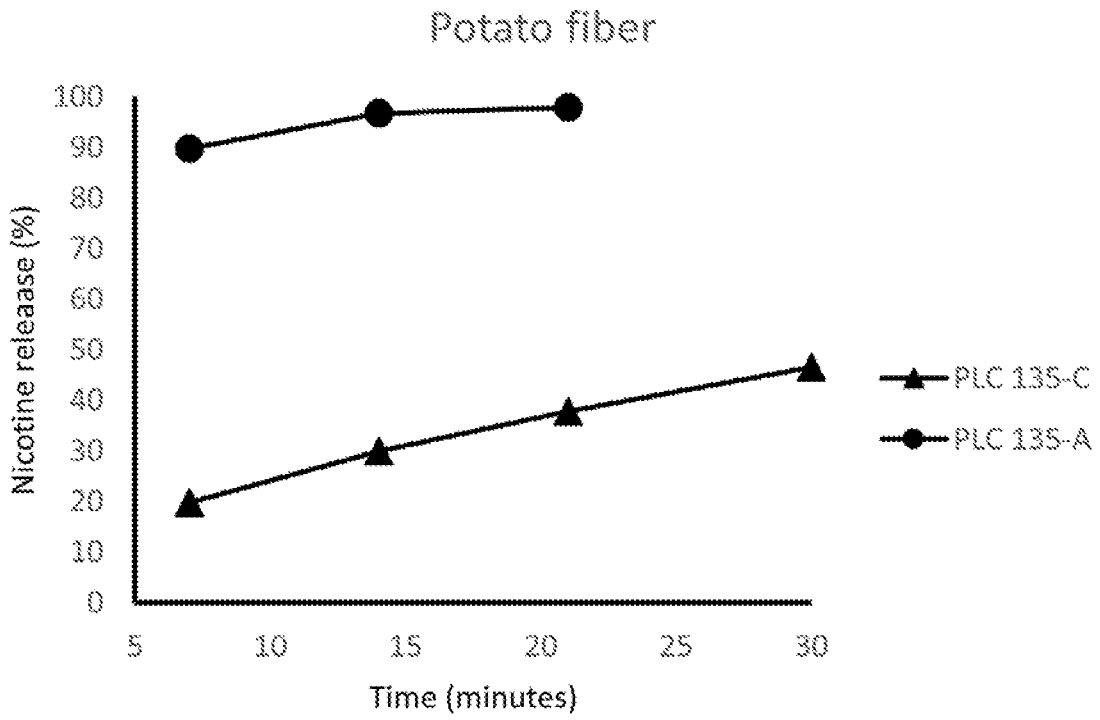

Nicotine release profiles for PLC135-A and PLC135-C are shown in FIG. 9.

As can be seen from table 25 and FIGS. 7-9, lowering the amount of pouch composition unexpectedly increases the relative nicotine release from the pouch. This can be observed for pouches based on bamboo fiber containing PLC133 pouch composition, wheat fiber containing PLC134 pouch composition, as well as potato fiber containing PLC135 pouch composition. Also, it can be observed that very high degree of nicotine release may be obtained.

Example 9: Release of Nicotine

Various pouches were subjected to tests to measure nicotine release.

Test Method

The method of example 7 was used.

Results

Various samples with different amount of pouch composition and different pouch surface area as outlined in Ex 5L, table 21 were measured.

The measured nicotine release profiles are shown in table 26.

TABLE 26

| Nicotine release profiles showing release of nicotine in % of total nicotine content. | | | | | | | | |
|---|---|---|---|---|---|---|---|---|
| Pouches | PLC 130-I | PLC 130-II | PLC 130-III | PLC 131-I | PLC 131-II | PLC 131-III | PLC 132-I | PLC 132-II |
| Time (minutes) | Release of nicotine in percentage of total nicotine content | | | | | | | |
| 7 | 32 | 24 | 20 | 67 | 62 | 53 | 47 | 40 |
| 14 | 46 | 36 | 30 | 85 | 77 | 69 | 62 | 56 |
| 21 | 56 | 46 | 38 | 92 | 84 | 77 | 71 | 68 |
| 30 | 66 | 56 | 46 | 96 | 88 | 84 | 78 | 78 |

Figure 10:
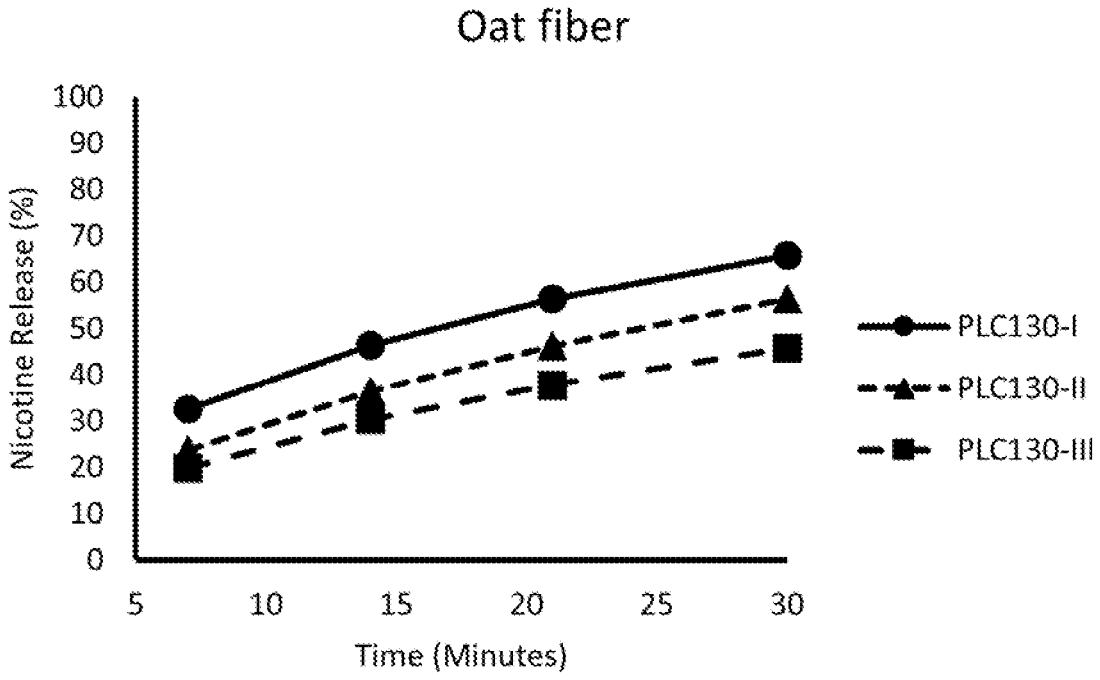
FIGS. 10-12 illustrate fast nicotine release according to example 9.

Nicotine release profiles for PLC130-I, PLC130-II, and PLC130-III are shown in FIG. 10.

Figure 11:
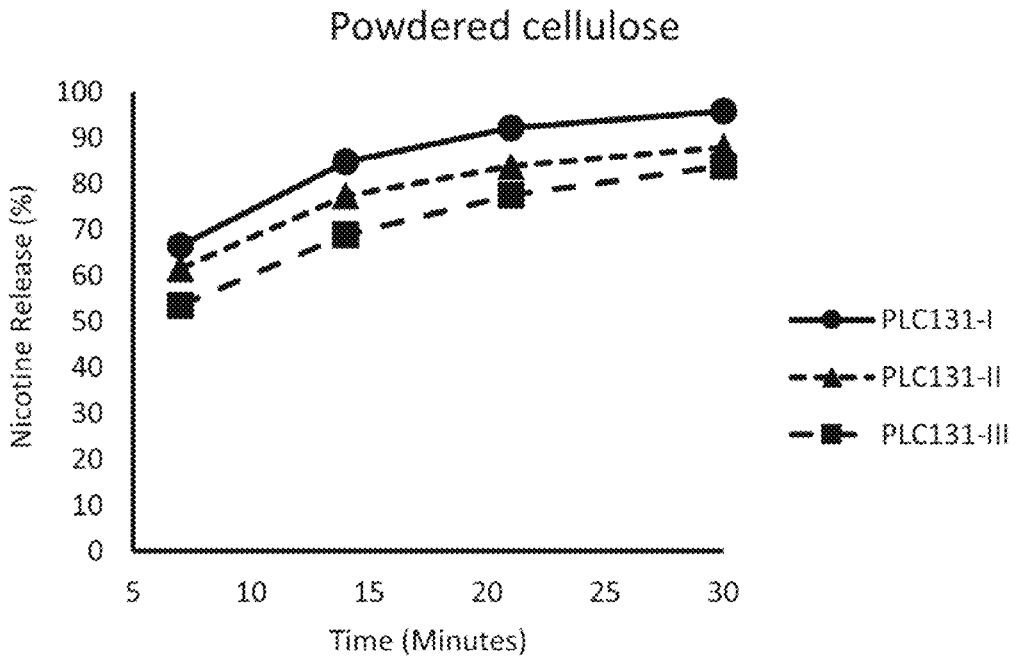

Nicotine release profiles for PLC131-I, PLC131-II, and PLC131-III are shown in FIG. 11.

Figure 12:
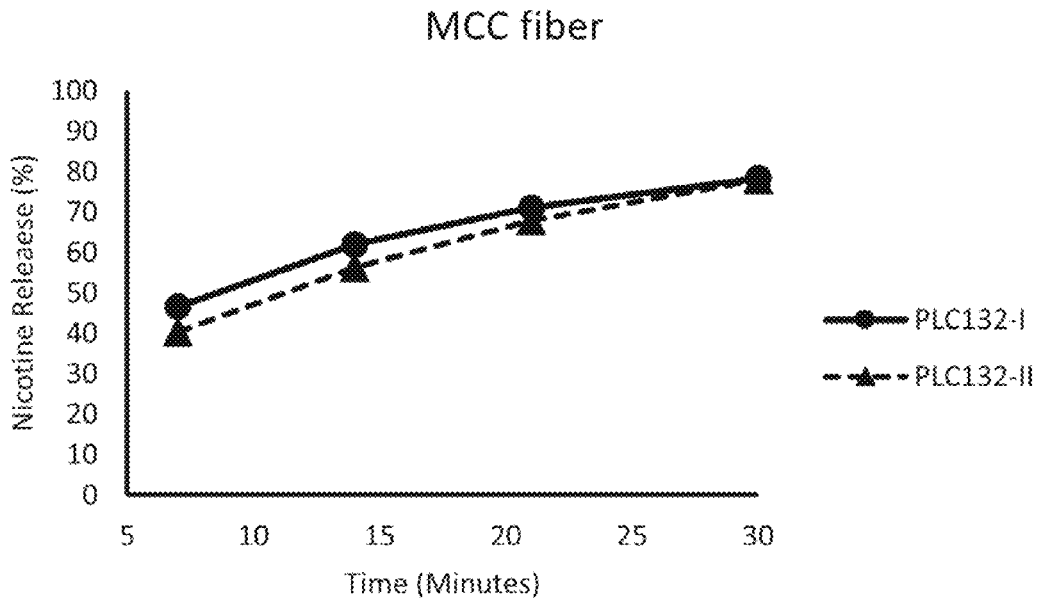

Nicotine release profiles for PLC132-I and PLC132-II are shown in FIG. 12.

As can be seen from table 26 and FIGS. 10-12, lowering the amount of pouch composition unexpectedly increases the relative nicotine release from the pouch, even when simultaneously lowering the pouch surface area, corresponding to a nearly constant degree of filling of the pouch. This can be observed for pouches based on oat fiber containing PLC130 pouch composition, powdered cellulose fiber containing PLC131 pouch composition, as well as MCC fiber containing PLC132 pouch composition. Also, it can be observed that very high degree of nicotine release may be obtained, especially for powdered cellulose fiber containing PLC131 pouch composition.

Example 10: Release of Nicotine

Various pouches were subjected to tests to measure nicotine release.

Test Method

The method of example 7 was used.

Results

Various samples with different amount of pouch composition (but with a fixed total amount of nicotine) and a fixed pouch surface area as outlined in Ex 5K, table 18B were measured.

The measured nicotine release profiles are shown in table 27.

TABLE 27

| Nicotine release profiles showing release of nicotine in % of total nicotine content. | | | |
|---|---|---|---|
| | Pouches | | |
| Time (minutes) | PLC140 | PLC141 | PLC142 |
| | Release of nicotine in percentage of total nicotine content | | |
| 7 | 49 | 43 | 25 |
| 14 | 65 | 58 | 38 |
| 21 | 74 | 68 | 48 |
| 30 | 81 | 76 | 58 |

Figure 13:
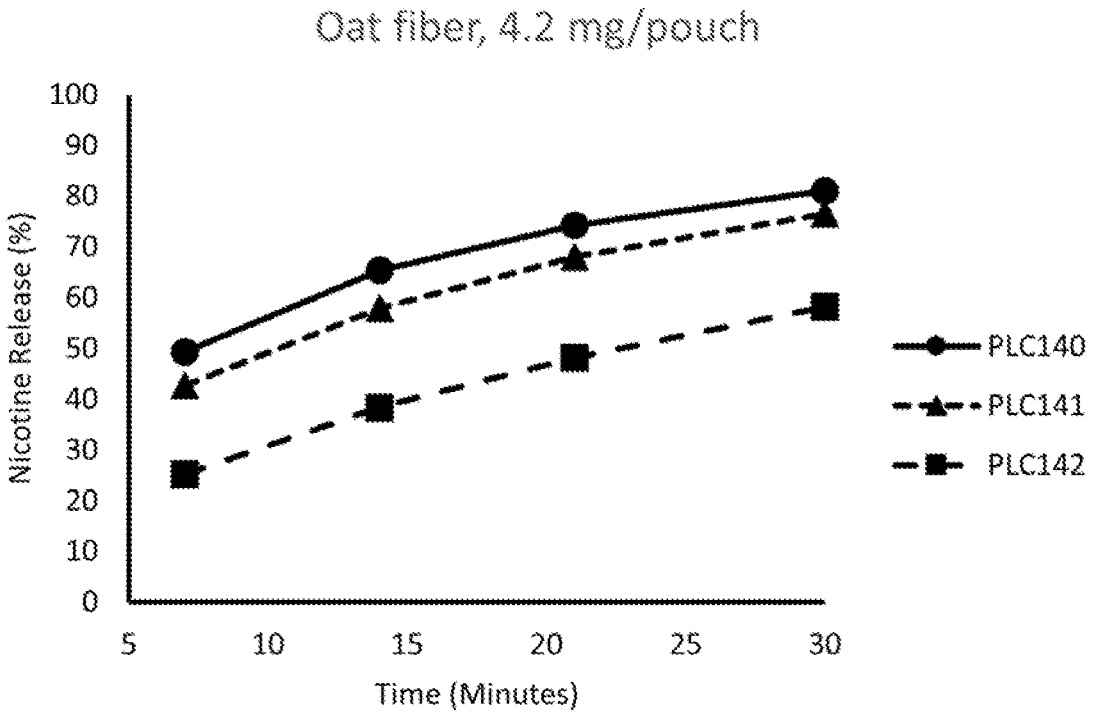
FIG. 13 illustrates fast nicotine release according to example 10.

Nicotine release profiles for PLC140, PLC141, and PLC142 are shown in FIG. 13.

As can be seen from table 27 and FIG. 13, lowering the amount of pouch composition unexpectedly increases the relative nicotine release from the pouch, even when maintaining the total nicotine amount in the pouch. The pouch compositions PLC140-PLC142 differ only by the content (weight %) of nicotine component (here nicotine premix II), with the content (weight %) of sugar alcohol being adjusted correspondingly. Also, it can be observed that very high degree of nicotine release may be obtained.

Example 11: Release of Nicotine

Pouch PLC126A-X outlined in Ex 5L, table 20, with a total amount of pouch composition of 80 mg and pouch composition PLC126A, was subjected to tests to measure nicotine release.

Test Method

The method of example 7 was used.

Results

The measured nicotine release profiles are shown in table 28.

TABLE 28

| Nicotine release profiles showing release of nicotine in % of total nicotine content. | |
|---|---|
| Time (minutes) | Pouches PLC 126A-X Release of nicotine in percentage of total nicotine content |
| 7 | 62 |
| 14 | 84 |
| 21 | 94 |
| 30 | 97 |

Figure 14:
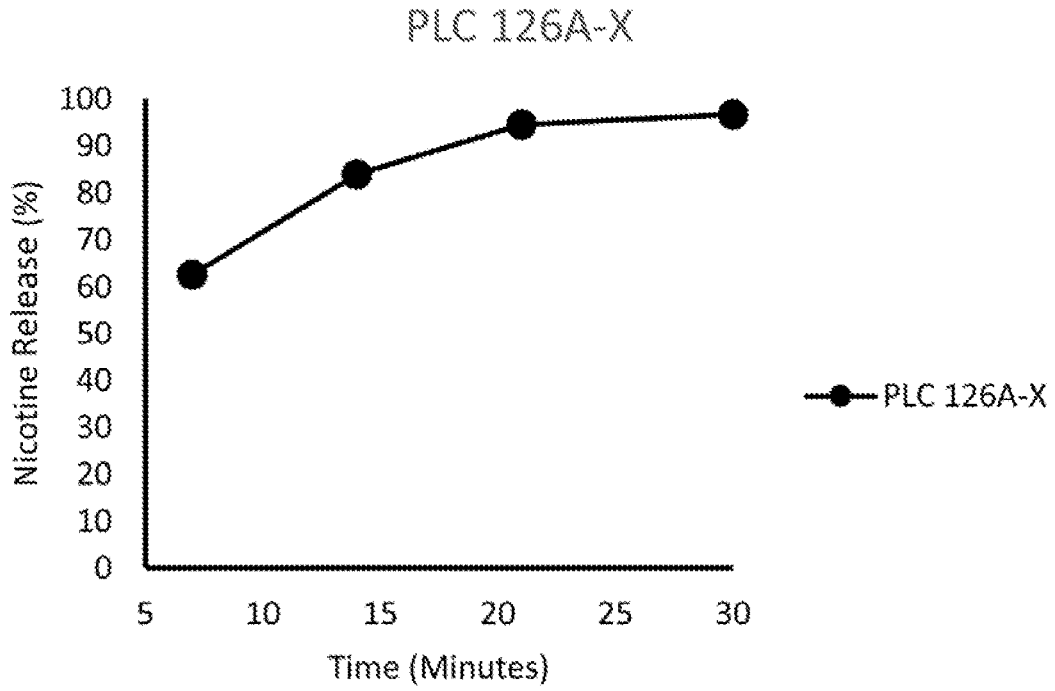
FIG. 14 illustrates fast nicotine release according to example 11.

Nicotine release profile for PLC126A-X is shown in FIG. 14.

As can be seen from table 28 and FIG. 14 very high degree of nicotine release may be obtained for pouch PLC126A-X.

The invention claimed is:

1. A nicotine pouched product comprising a pouch composition and a saliva-permeable pouch enclosing said pouch composition, the pouch composition comprising nicotine and a pouch substrate, the pouch substrate comprising water-insoluble fiber, said pouch composition comprising nicotine in an amount of at least 0.25% by weight of the pouch composition, said pouch composition comprising one or more alkaline pH regulating agents, and wherein the pouched product comprises said pouch composition in an amount of no more than 250 mg, wherein the pouch composition comprises said water-insoluble fiber in an amount of at least 15% by weight of the pouch composition, and wherein the pouch composition comprises water in an amount of no more than 10% by weight of the pouch composition.

2. The nicotine pouched product according to claim 1, wherein the pouched product comprises said pouch composition in an amount of no more than 200 mg.

3. The nicotine pouched product according to claim 1, wherein the water-insoluble fiber is a non-tobacco fiber.

4. The nicotine pouched product according to claim 1, wherein the pouch composition is free of tobacco fibers.

5. The nicotine pouched product according to claim 1, wherein the saliva-permeable pouch has a maximum dimension of no more than 30 mm.

6. The nicotine pouched product according to claim 1, wherein the pouch composition comprises at least one sugar alcohol.

7. The nicotine pouched product according to claim 6, wherein the pouch composition comprises said at least one sugar alcohol in an amount of at least 1% by weight of the pouch composition.

8. The nicotine pouched product according to claim 6, wherein the pouch composition has a weight ratio of water-insoluble fiber to sugar alcohol, said weight ratio being from 0.1 to 10.

9. The nicotine pouched product according to claim 6, wherein said at least one sugar alcohol comprises one or more selected from the group consisting of xylitol, maltitol, mannitol, erythritol, isomalt, sorbitol, lactitol, glycerol, and any combinations thereof.

10. The nicotine pouched product according to claim 6, wherein said at least one sugar alcohol comprises one or more selected from the group consisting of xylitol, maltitol, mannitol, erythritol, isomalt, sorbitol, lactitol, and any combinations thereof.

11. The nicotine pouched product according to claim 1, wherein the pouch composition comprises non-tobacco water-insoluble fiber in an amount of at least 30% by weight of the pouch composition.

12. The nicotine pouched product according to claim 1, wherein the water-insoluble fiber comprises one or more selected from the group consisting of wheat fibers, pea fibers, rice fiber, maize fibers, oat fibers, tomato fibers, barley fibers, rye fibers, sugar beet fibers, buckwheat fibers, potato fibers, apple fibers, cocoa fibers, bran fibers, bamboo fibers, powdered cellulose, and any combination thereof.

13. The nicotine pouched product according to claim 1, wherein the water-insoluble fiber comprises microcrystalline cellulose.

14. The nicotine pouched product according to claim 1, wherein the nicotine is selected from the group consisting of a nicotine salt; nicotine free base; a nicotine-ion exchange resin combination; a nicotine inclusion complex or nicotine in any non-covalent binding form; nicotine bound to zeolites; nicotine bound to cellulose or starch microspheres; and mixtures thereof.

15. The nicotine pouched product according to claim 1, wherein the nicotine comprises a nicotine salt.

16. The nicotine pouched product according to claim 1, wherein the pH regulating agent is selected from the group consisting of sodium carbonate, sodium bicarbonate, potassium carbonate, and magnesium carbonate, potassium bicarbonate, trometamol, phosphate buffer, and any combination thereof.

17. The nicotine pouched product according to claim 1, wherein the pouched product has a Surface Area to Volume (SAV) ratio of at least 0.6.

18. The nicotine pouched product according to claim 1, wherein the pouch composition further comprises one or more solubilizers.

19. The nicotine pouched product according to claim 1, wherein the pouch comprises a woven or non-woven web or fabric.

20. The nicotine pouched product according to claim 1, wherein the pouch composition comprises water in an amount of no more than 5% of the pouch composition.

* * * * *